US009636689B2

(12) United States Patent
Smith et al.

(10) Patent No.: US 9,636,689 B2
(45) Date of Patent: May 2, 2017

(54) ROTATING MAGNETIC ACTUATOR

(71) Applicant: LUMINEX CORPORATION, Austin, TX (US)

(72) Inventors: Eric Smith, Austin, TX (US); Jon Isom, Austin, TX (US); Adam Schilffarth, Cedar Park, TX (US)

(73) Assignee: LUMINEX CORPORATION, Austin, TX (US)

( * ) Notice: Subject to any disclaimer, the term of this patent is extended or adjusted under 35 U.S.C. 154(b) by 498 days.

(21) Appl. No.: 14/134,042

(22) Filed: Dec. 19, 2013

(65) Prior Publication Data

US 2014/0175019 A1 Jun. 26, 2014

Related U.S. Application Data

(60) Provisional application No. 61/745,430, filed on Dec. 21, 2012.

(51) Int. Cl.

| | |
|---|---|
| ***B03C 1/03*** | (2006.01) |
| ***B03C 1/28*** | (2006.01) |
| ***B03C 1/033*** | (2006.01) |

(52) U.S. Cl.

CPC ..... *B03C 1/03* (2013.01); *B03C 1/0332* (2013.01); *B03C 1/288* (2013.01); *B03C 2201/18* (2013.01)

(58) Field of Classification Search

CPC ..... B03C 1/029; B03C 1/03; B03C 1/0332; B03C 1/28; B03C 1/288; B03C 1/30; B03C 2201/18; B03C 2201/22; B03C 2201/26; H01F 7/0205; H01F 7/021; H01F 7/0273; H01F 7/0294; G01N 1/4044; G01N 35/0098; B01L 3/5085; B01L 9/523; B01L 2300/0829; B01L 2400/043

See application file for complete search history.

(56) References Cited

U.S. PATENT DOCUMENTS

| | | | | |
|---|---|---|---|---|
| 2003/0040129 | A1 | 2/2003 | Shah | 506/32 |
| 2006/0057578 | A1 | 3/2006 | Willner et al. | 435/6.11 |
| 2006/0082225 | A1 | 4/2006 | Korenaga et al. | 310/12.06 |
| 2008/0290741 | A1 | 11/2008 | Cardon et al. | 310/12.06 |
| 2009/0191638 | A1 | 7/2009 | Schilffarth et al. | 436/50 |
| 2010/0068764 | A1 | 3/2010 | Sista et al. | 435/79 |
| 2010/0075430 | A1 | 3/2010 | Hofstadler et al. | 436/94 |
| 2011/0012440 | A1 | 1/2011 | Toyota et al. | 310/12.24 |

(Continued)

FOREIGN PATENT DOCUMENTS

WO WO 2009/013683 1/2009

OTHER PUBLICATIONS

International Search Report and Written Opinion, issued in PCT/US2013/076141, dated Apr. 9, 2014.

(Continued)

*Primary Examiner* — David C Mellon

(74) *Attorney, Agent, or Firm* — Parker Highlander PLLC

(57) ABSTRACT

Magnetic actuators comprising at least one linear subarray are presented. Systems comprising such magnetic actuators and methods for using such magnetic actuators to isolate magnetic particles in a fluid are also presented. Magnetic actuators comprising at least four uniform magnets are also presented, as are systems comprising such magnetic actuators and methods for using such magnetic actuators to isolate magnetic particles in a fluid.

20 Claims, 16 Drawing Sheets

(56) References Cited

U.S. PATENT DOCUMENTS

| | | | | |
|---|---|---|---|---|
| 2011/0088491 | A1* | 4/2011 | Krueger | B01F 11/0014 73/863.11 |
| 2011/0168618 | A1* | 7/2011 | Danov | B03C 1/02 210/222 |
| 2012/0184037 | A1 | 7/2012 | Schilffarth et al. | 436/50 |

OTHER PUBLICATIONS

International Search Report and Written Opinion, issued in PCT/US2013/076464, dated Apr. 7, 2014.

* cited by examiner

ROTATING MAGNETIC ACTUATOR

CROSS REFERENCE TO RELATED APPLICATIONS

This application claims priority to U.S. Provisional Patent Application Ser. No. 61/745,430, filed Dec. 21, 2012, the contents of which are incorporated by reference herein

TECHNICAL FIELD

Embodiments of the present disclosure relate to actuators comprising rotating magnets. Particular embodiments relate to magnetic actuators comprising permanent magnets arranged in a linear array in order to create a magnetic field that exists primarily on one side of the linear array, which arrays are configured to rotate between a first position (e.g. a max state) and a second position (e.g. a min state). Embodiments of the rotating magnet arrays disclosed herein are configured for use with a well plate comprising a plurality of wells in order to isolate magnetic particles in a fluid assay.

BACKGROUND

The following descriptions and examples are not admitted to be prior art by virtue of their inclusion within this section.

Fluid assays are used for a variety of purposes, including but not limited to biological screenings and environmental assessments. Often, particles are used in fluid assays to aid in the detection of analytes of interest within a sample. In particular, particles provide a substrate for carrying reagents configured to react with analytes of interest within a sample such that the analytes may be detected. In many cases, magnetic materials are incorporated into particles such that the particles may be immobilized by magnetic fields during the preparation and/or analysis of a fluid assay. In particular, particles may be immobilized during an assay preparation process such that excess reagents and/or reactionary byproducts superfluous to the impending assay may be removed. In addition or alternatively, particles may be immobilized during analysis of a fluid assay such that data relating to analytes of interest in the assay may be collected from a fixed object.

Immobilization is typically performed for only a fraction of the time used to prepare or analyze an assay such that the particles may be allowed to be suspended in or allowed to flow with the assay. In addition, the immobilization may be performed once or multiple times during the preparation or analysis of a fluid assay depending on the specifications of the process. For such reasons, it is generally necessary to intermittently introduce and retract a magnetic actuator in the vicinity of a vessel comprising the magnetic particles. In some cases, however, the inclusion of a magnetic actuation device within a fluid assay system may complicate the design of the system, particularly hindering the ability to introduce assay/sample/reagent plates and/or vessels into the system.

SUMMARY OF THE INVENTION

Disclosed are embodiments of magnetic actuators, systems comprising such magnetic actuators, and methods of using such actuators and systems. In a specific embodiment, a magnetic actuator configured to isolate particles in a fluid assay is disclosed, the magnetic actuator comprising: a first magnet magnetized in a first direction, a second magnet magnetized in a second direction, a third magnet magnetized in a third direction, and a fourth magnet magnetized in a fourth direction, wherein the directions are not identical and each direction is either parallel or orthogonal to the other directions such that a Halbach effect is induced on one side of the magnets; a motor configured to rotate at least two of the first, second, third and fourth magnets; and a lateral support member configured to support the motor, the first magnet, the second magnet, the third magnet, and the fourth magnet.

In another embodiment, the magnetic actuator further comprises at least one linear magnet array comprising the first magnet, the second magnet, the third magnet, and the fourth magnet, where each of the first, second, third and fourth magnets is adjacent to at least one other of the first, second, third and fourth magnets; wherein the motor is configured to rotate at least two of the first, second, third and fourth magnets in the linear magnet array approximately 180 degrees about an axis through the first magnet, the second magnet, the third magnet, and the fourth magnet.

In still another embodiment, the motor is configured to rotate the first, second, third and fourth magnets in the linear magnet array and wherein the first, second, third and fourth magnets in the linear magnet array are configured to rotate together. In such an embodiment, the magnetic actuator further comprises four linear magnet arrays.

In another exemplary embodiment, the magnetic actuator is configured such that the first magnet further comprises a first axis of rotation; the second magnet further comprises a second axis of rotation; the third magnet further comprises a third axis of rotation; the fourth magnet further comprises a fourth axis of rotation; and wherein each axis of rotation is substantially parallel to the other axes of rotation and the axes of rotation are not identical. In some embodiments, the magnetic actuator is configured such that each of the first, second, third and fourth magnets is configured to rotate approximately 90 degrees and adjacent magnets the first, second, third and fourth magnets are configured to rotate in opposite directions. In other embodiments, the magnetic actuator is configured such that, two magnets of the first, second, third and fourth magnets are configured to rotate about 180 degrees, two magnets of the first, second, third and fourth magnets are configured to remain stationary, the two magnets configured to rotate about 180 degrees are not adjacent to each other, and the two magnets configured to remain stationary are not adjacent to each other.

In another exemplary embodiment, a magnetic actuator configured to isolate particles in a fluid assay is disclosed, the magnetic actuator comprising: a first magnet array comprising: an origin; and a linear subarray, the linear subarray comprising: a first magnet element magnetized in a first direction relative to the origin; a second magnet element magnetized in a second direction relative to the origin; a third magnet element magnetized in a third direction relative to the origin; and a fourth magnet element magnetized in a fourth direction relative to the origin; where the first direction, the second direction, the third direction, and the fourth direction are different from one another and either substantially parallel or substantially orthogonal to one another such that a Halbach effect is induced in the linear subarray; where the first magnet array has a length, an axis of rotation along its length, a max side, and a min side; a motor coupled to the first magnet array and configured to rotate at least one magnet element of the first, second, third and fourth magnet elements about its axis of rotation; and a lateral support member configured to support the first magnet array and the motor.

In some embodiments, the magnetic actuator further comprises a second magnet array comprising: an origin; and a linear subarray, each linear subarray comprising: a first magnet element magnetized in a first direction relative to the origin; a second magnet element magnetized in a second direction relative to the origin; a third magnet element magnetized in a third direction relative to the origin; and a fourth magnet element magnetized in a fourth direction relative to the origin; where the first direction, the second direction, the third direction, and the fourth direction are different from one another and either substantially parallel or substantially orthogonal to one another such that a Halbach effect is induced in the linear subarray; where the second magnet array has a length, an axis of rotation along its length, a max side, and a min side, and where the lateral support member is further configured to support the second magnet array.

In some embodiments of the magnetic actuator, each of the first, second, third, and fourth magnet elements in each of the first and second magnet arrays are configured to rotate together. In other embodiments of magnetic actuator, the second magnet array may be coupled to the first magnet array such that rotation of the first magnet array about the first axis of rotation rotates the second magnet about the second axis of rotation.

In still other embodiments of the magnetic actuator at least some of the first, second, third, and fourth magnet elements in a magnet array are configured to rotate independently from others of the first, second, third, and fourth magnet elements in that magnet array.

In another embodiment, a magnetic actuator configured to isolate particles in a fluid assay is disclosed, the magnetic actuator comprising: a first pair of magnet arrays rotatable together, each magnet array comprising a plurality of magnet elements arranged to induce a Halbach effect, where each magnet array has a length, an axis of rotation, a max side, and a min side; a first motor coupled to the first pair of magnet arrays through a gearset and configured to rotate the first pair of magnet arrays about their respective axes of rotation; a second pair of magnet arrays rotatable together, each magnet array comprising a plurality of magnet elements arranged to induce a Halbach effect, where each magnet array has a length, an axis of rotation along its length, a max side, and a min side; a second motor coupled to the second pair of magnet arrays through a gearset and configured to rotate the second pair of magnet arrays about their respective axes of rotation; and a lateral support member configured to support the magnet arrays and the motors; where the magnetic actuator is configured to be coupled to an assay preparation module.

In still another embodiment, a magnetic actuator is disclosed that is configured to isolate particles in a fluid assay, the magnetic actuator comprising: a first uniform magnet having a length, a width, and a first axis of rotation substantially parallel to its length, where the first uniform magnet is magnetized substantially uniformly through its width in a first direction; a second uniform magnet having a length, a width, and a second axis of rotation substantially parallel to its length, where the second uniform magnet is magnetized substantially uniformly through its width in a second direction; a third uniform magnet having a length, a width, and a third first axis of rotation substantially parallel to its length, where the first uniform magnet is magnetized substantially uniformly through its width in a third direction; and a fourth uniform magnet having a length, a width, and a fourth axis of rotation substantially parallel to its length, where the fourth uniform magnet is magnetized substantially uniformly through its width in a fourth direction; wherein the first axis of rotation, the second axis of rotation, the third axis of rotation, and the fourth axis of rotation are not identical to each other and are substantially parallel to each other; wherein the first direction, second direction, third direction, and fourth direction are not identical to each other and each direction is parallel or orthogonal to each other direction; and wherein the uniform magnets are configured to induce a Halbach effect on the same side of all the uniform magnets; a motor configured to rotate at least two of the uniform magnets; and a lateral support member configured to support the uniform magnets. In some embodiments of magnetic actuator, each magnet is configured to rotate 90 degrees and adjacent magnets are configured to rotate in opposite directions. In other embodiments of magnetic actuator, wherein two magnets are configured to rotate about 180 degrees, two magnets are configured to remain stationary, rotating magnets are not adjacent to each other, and stationary magnets are not adjacent to each other.

In still another embodiment, a system configured to isolate particles in a fluid assay is disclosed, the system comprising: a chassis; a magnetic actuator coupled to the chassis, the magnetic actuator having rotatable magnets; a tub coupled to the chassis; and a well plate coupled to the tub and comprising a plurality of wells arranged in columns and rows; and where the tub is configured to support the well plate such that each magnet or magnet array is adjacent to at least one column of wells.

In some embodiments of the system, the well plate further comprises eight columns and each magnet array is adjacent to two columns of wells.

In yet another embodiment, a method for collecting a sample of magnetic particles from a liquid is presented, comprising: obtaining a system comprising: a chassis; a magnetic actuator coupled to the chassis, the magnetic actuator having rotatable magnets; a tub coupled to the chassis; and a well plate coupled to the tub and comprising a plurality of wells arranged in columns and rows; and where the tub is configured to support the well plate such that each magnet or magnet array is adjacent to at least one column of wells; obtaining a first suspension comprising a plurality of magnetic particles suspended in a first liquid; introducing a volume of the first suspension into at least one well; adjusting the magnets to a first position or max state such that a magnetic force is exerted on at least one column of wells; forming a pellet of magnetic particles in at least one well; and aspirating a portion of the first liquid from at least one well.

In some embodiments the method further comprises rotating the magnet arrays to a second position or min state such that substantially no magnetic force is exerted on any column of wells.

In other embodiments the method further comprises obtaining a second liquid and introducing the second liquid into at least one well comprising magnetic particles.

In still other embodiments the method further comprises agitating the magnetic particles in at least one well to form a second suspension comprising the magnetic particles suspended in the second liquid.

Non-limiting examples of magnetic particles that may be used in connection with the methods and systems described herein include magnetic nanoparticles and magnetic microspheres (sometimes referred to as "beads"). As used herein, the term "nanoparticles" refers to particles with a diameter of less than 1 micrometer. In certain embodiments the nanoparticles have a diameter between 5-500 nanometers. Magnetic microspheres typically have a diameter in the range of 1-500 micrometers. In certain embodiments, the magnetic microspheres have a diameter in the range of 5-25 micrometers. The magnetic particles may be coated with or coupled to functional groups to enhance the isolation of particular components from a sample. For example magnetic silica particles or magnetic glass particles may be employed for the isolation of nucleic acids from a sample. Magnetic particles coupled to, for example, oligonucleotides or antibodies may be used to isolate a particular target nucleic acid or protein, respectively.

The term "coupled" is defined as connected, although not necessarily directly, and not necessarily mechanically.

The terms "a" and "an" are defined as one or more unless this disclosure explicitly requires otherwise.

The term "substantially" and its variations (e.g. "approximately" and "about") are defined as being largely but not necessarily wholly what is specified (and include wholly what is specified) as understood by one of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. For example, a magnetic actuator that comprises a magnet array possesses at least one magnet array, but may possess more than one magnet array.

Furthermore, a device or structure that is configured in a certain way is configured in at least that way, but may also be configured in ways that are not listed. Metric units may be derived from the English units provided by applying a conversion factor.

The feature or features of one embodiment may be applied to other embodiments, even though not described or illustrated, unless expressly prohibited by this disclosure or the nature of the embodiments.

Any embodiment of any of the disclosed devices and methods can consist of or consist essentially of—rather than comprise/include/contain/have—any of the described elements and/or features and/or steps. Thus, in any of the claims, the term "consisting of" or "consisting essentially of" can be substituted for any of the open-ended linking verbs recited above, in order to change the scope of a given claim from what it would otherwise be using the open-ended linking verb.

Other features and associated advantages will become apparent with reference to the following detailed description of specific embodiments in connection with the accompanying drawings.

BRIEF DESCRIPTION OF THE DRAWINGS

The following drawings illustrate by way of example and not limitation. For the sake of brevity and clarity, every feature of a given structure may not be labeled in every figure in which that structure appears. Identical reference numbers do not necessarily indicate an identical structure. Rather, the same reference number may be used to indicate a similar feature or a feature with similar functionality, as may non-identical reference numbers.

The embodiments of the present rotating magnetic actuators and their components shown in at least FIGS. 1 and 6-10 are drawn to scale.

FIG. 1 is an isometric view of an embodiment of a magnet array.

FIG. 7 is a perspective view of the embodiment of FIG. 6A, showing the chassis and the tub coupled to the chassis.

FIG. 8 is a perspective view of the embodiment of FIG. 7 showing the chassis and an embodiment of a wellplate coupled to the chassis.

FIG. 9 is a perspective view of the embodiment of FIG. 8 showing the lid in the closed position.

FIG. 10 is an embodiment of a portion of a well plate comprising a plurality of wells arranged in columns and rows.

DETAILED DESCRIPTION

Figure 2:
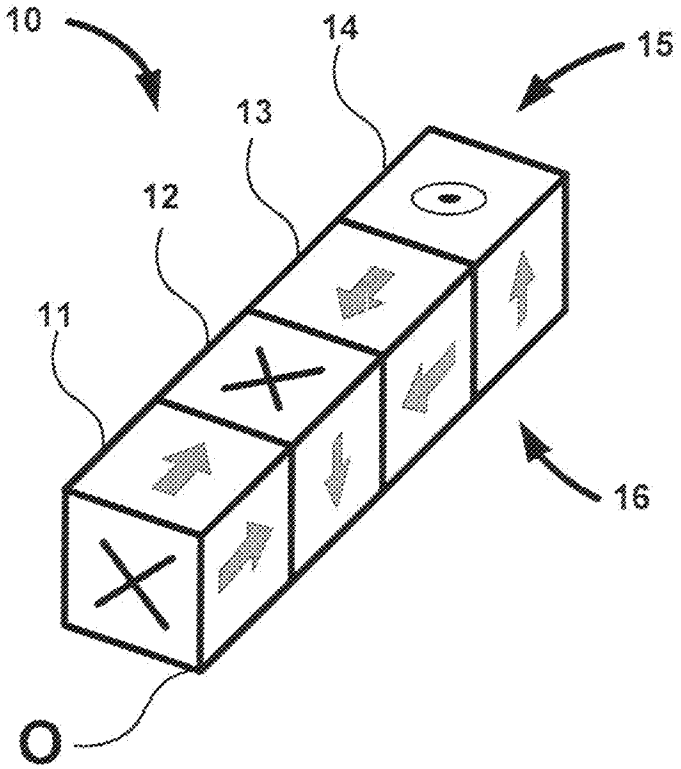
FIG. 2 is an isometric view of an embodiment of a linear subarray.

Various features and advantageous details are explained more fully with reference to the non-limiting embodiments that are illustrated in the accompanying drawings and detailed in the following description. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those of ordinary skill in the art from this disclosure.

In the following description, numerous specific details are provided to provide a thorough understanding of the disclosed embodiments. One of ordinary skill in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Disclosed embodiments of the invention use permanent magnet elements arranged in arrays to create a magnetic field that exists (i.e., substantially exists) on only one side of a plane. Such arrays are known in the art as Halbach arrays.

Embodiments of magnetic actuators comprising magnet arrays (i.e., Halbach arrays), systems comprising such magnetic actuators, and methods for using such actuators and systems are discussed in more detail below. In particular, the disclosed embodiments of Halbach arrays are configured to apply a force to a plurality of microscale particles in a suspension sufficient to pull the particles out of suspension. The force a Halbach array applies to the particles depends on the composition of the particles, and is proportional to either the gradient (i.e., change over distance) or the square of the gradient of the applied magnetic field. Accordingly, as used here, one magnet (or magnet array) is "stronger" than another when it can apply a greater force to the particles which are to be pulled out of suspension, all else being equal.

The following figures illustrate embodiments of magnetic actuators, fluid assay systems comprising such magnetic actuators, and methods employing such magnetic actuators. In the following illustrations, numbers are used to indicate a generic structure or feature while letters are used to indicate specific instances of that structure or feature. For example, a generic magnet array is referred to with reference numeral 100, while a first magnet array is referred to with reference numeral 100*a*. Descriptions of the generic magnet array 100 also pertain to the specific instance of the magnet array, e.g., first magnet array 100*a*.

Magnetic Actuator

Embodiments of magnetic actuators comprising rotatable magnets are discussed below. In various embodiments, rotatable magnets may be magnet arrays 100 or uniform magnets 110.

Figure 1:
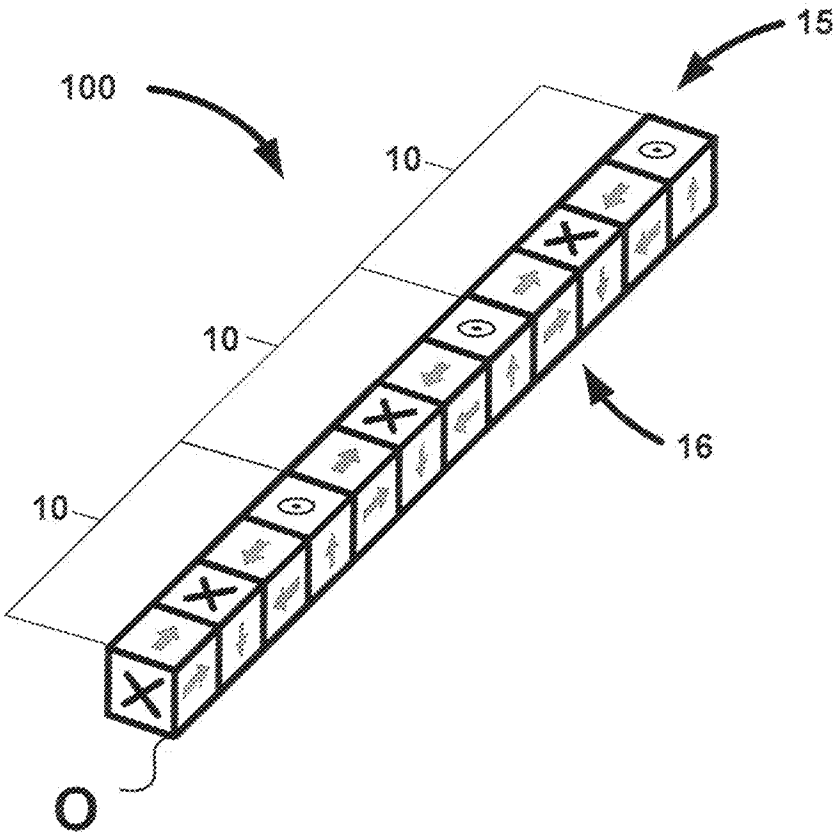

FIG. 1 is a perspective illustration of embodiments of a magnet array 100 comprising at least one linear subarray 10. In the illustrated embodiment, magnet array 100 comprises three linear subarrays 10, though magnet array 100 may comprise one, two, four, five, six, seven, eight, nine, ten, eleven, twelve, or more linear subarrays 10. Magnet array 100 comprises an origin O, a max side 15 and a min side 16.

FIG. 2 is a perspective illustration of an embodiment of a linear subarray 10 comprising four elements: a first magnet element 11, a second magnet element 12, a third magnet element 13, and a fourth magnet element 14. Each magnet element is a permanent magnet that has been magnetized through one dimension of the magnet (e.g., though its length or height) substantially parallel to that dimension.

In these and subsequent figures, arrows indicate the direction of magnetization through the element: the tip of the arrow or a bulls-eye represents N, while the base of the arrow or an "X" represents S. The magnetization directions of each element are either substantially parallel or substantially orthogonal (at right angles) to one another. Magnetization directions of adjacent elements are substantially orthogonal.

Each linear subarray 10 has a max side 15 and a min side 16. Configuring magnet elements in a Halbach array as shown causes the magnetic field to be concentrated at max side 15 (i.e., the Halbach array is between one to two times as strong on max side 15 as an identically sized, identically shaped magnet comprising the same material magnetized through its thickness), and causes the magnetic field to be substantially cancelled out at min side 16 (i.e., the Halbach array is between zero to one times as strong on min side 16 as an identically sized, identically shaped magnet comprising the same material magnetized through its thickness).

Figure 3A:
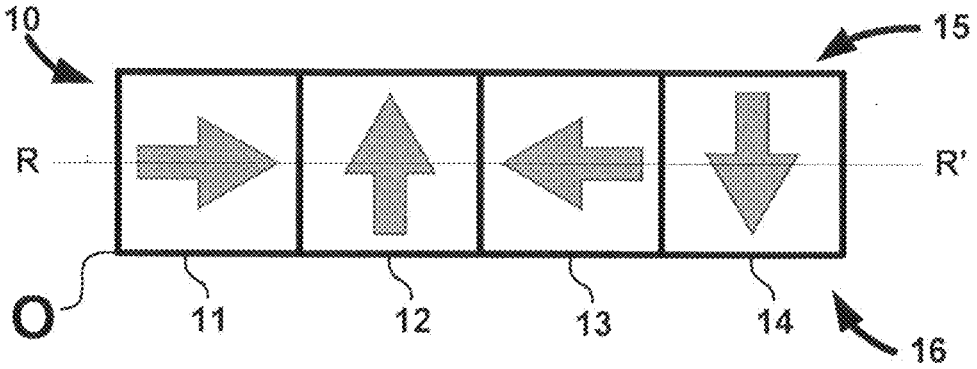
FIGS. 3A-3D depict configurations of embodiments of a linear subarray.

Embodiments of linear subarray 10 are shown in FIGS. 3A-3D. The embodiments depicted in FIG. 3A shows linear subarray 10 with first magnet element 11 at the origin O. In other embodiments shown in FIGS. 3B-3D respectively, second magnet element 12, third magnet element 13, or fourth magnet element 14 may be at the origin O. Each embodiment of linear subarray 10 comprises an axis of rotation (R-R'). In certain embodiments, the axis of rotation may be through the center of linear subarray 10. In any of the disclosed embodiments, linear subarray 10 or certain elements in linear subarray 10 may be configured to rotate about an eccentric axis (e.g., an axis that is closer to min side 16 than it is to max side 15). In such embodiments, the magnetic field of the min side may be nonzero, so it may be beneficial to maximize the distance from min side 16 a well plate.

All embodiments of magnet array 100 comprise at least one complete linear subarray 10 comprising first magnet element 11, second magnet element 12, third magnet element 13, and fourth magnet element 14, in the same order relative to one another. That is, in a magnet array 100 comprising at least two linear subarrays 10 and beginning at origin O, first magnet element 11 will be followed by second magnet element 12, second magnet element 12 will be followed by third magnet element 13, third magnet element 13 will be followed by fourth magnet element 14, and fourth magnet element 14 will be followed by first magnet element 11.

Consistent with the illustrations in FIGS. 1-3D, first magnet element 11 may be considered a "right" element; second magnet element 12 may be considered an "up" element; third magnet element 13 may be considered a "left" element; and fourth magnet element may be considered a "down" element.

Furthermore, certain embodiments comprise complete linear subarrays (i.e., there are equal numbers of first, second, third, and fourth magnet elements in an embodiment of a magnet array). In other embodiments, magnet array may be truncated (i.e., there are unequal numbers of first, second, third, and fourth magnet elements in an embodiment of a magnet array).

Figure 4A:
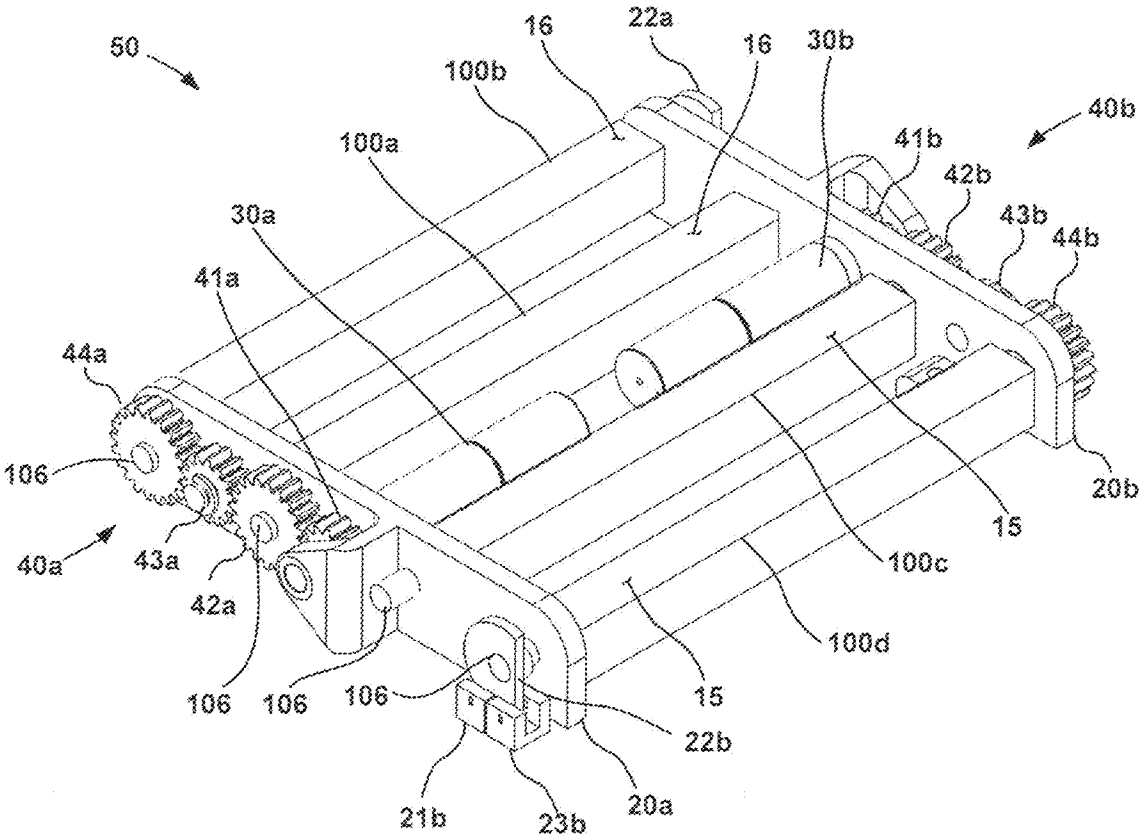
FIGS. 4A and 4B are isometric views of embodiments of a magnetic actuator.
Figure 4B:
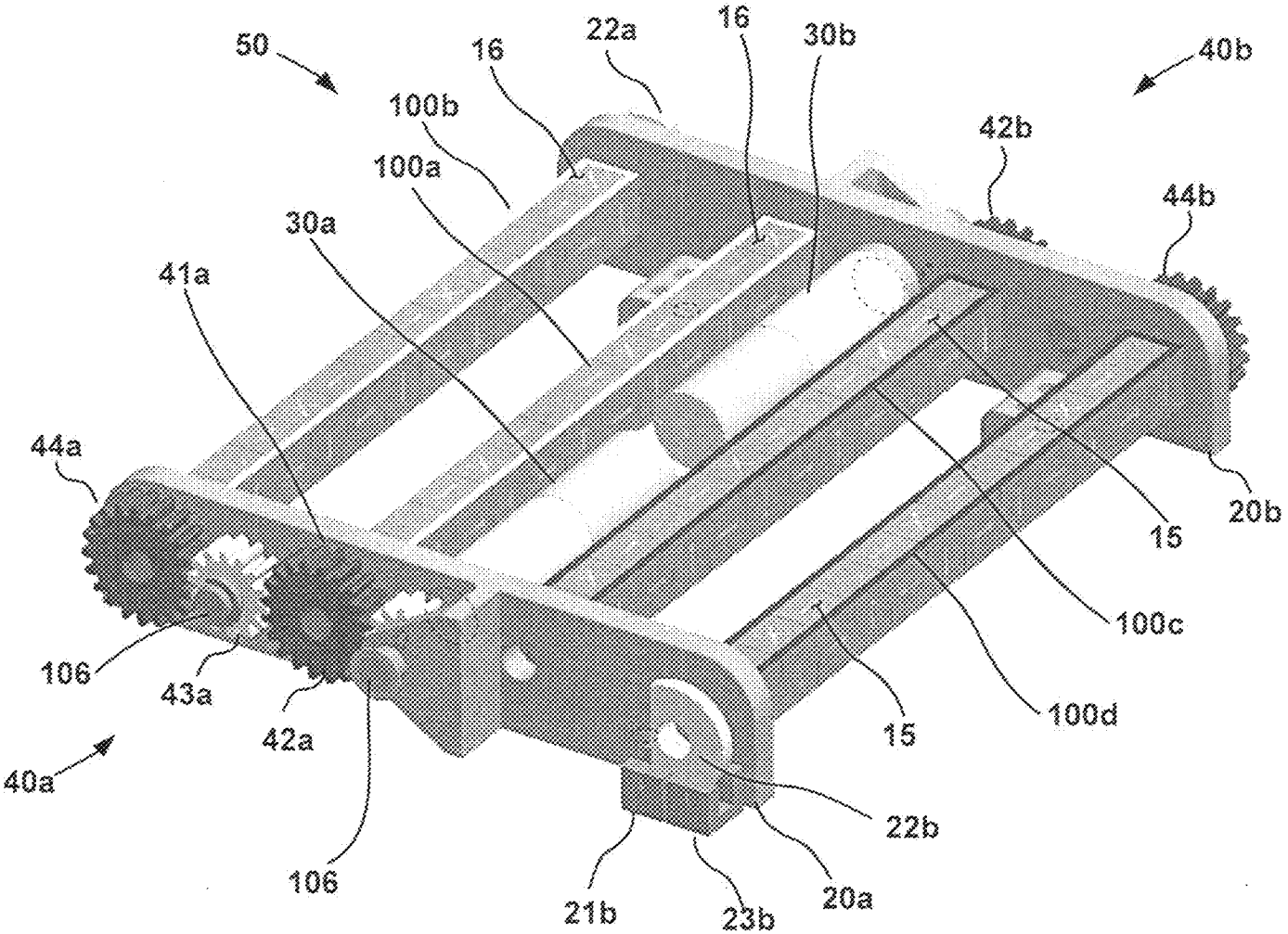

FIGS. 4A and 4B show isometric views of magnetic actuator 50 (known as the "linear configuration"), one embodiment of the present magnetic actuators 50. Actuator 50 comprises at least one magnet array coupled to a rotation motor, e.g. a motor configured to rotate at least one magnet or magnet array. In the illustrated embodiment, actuator 50 comprises four magnet arrays 100*a*, 100*b*, 100*c*, and 100*d*. In this embodiment, pairs of magnet arrays are coupled to a motor via a gearset such that one motor 30 moves two magnet arrays 100. In the illustrated embodiment, first rotation motor 30*a* is coupled to first magnet array 100*a* and second magnet array 100*b* via first gearset 40*a*. Second rotation motor 30*b* is coupled to third magnet array 100*c* and fourth magnet array 100*d* via second gearset 40*b*. Paired magnet arrays of actuator 50 move in substantially the same direction at substantially the same time when actuated by a rotation motor e.g., paired magnets 100 move synchronously. Thus, first magnet array 100*a* and second magnet array 100*b*, which are paired, move in substantially the same direction at substantially the same time when actuated by first rotation motor 30*a*. Third magnet array 100*c* and fourth magnet array 100*d*, which are also paired, move in substantially the same direction at substantially the same time when actuated by second rotation motor 30*b*. The magnet arrays and the motors are supported by lateral support members 20*a* and 20*b*.

In certain embodiments, the magnet arrays may be indexed such that each array begins with a different subarray. For example, first magnet array 100*a* could begin with the subarray shown in FIG. 3A, second magnet array 100*b* could begin with the subarray shown in FIG. 3B, third magnet array 100*c* could begin with the subarray shown in FIG. 3C, and fourth magnet array 100*d* could begin with the subarray shown in FIG. 3D.

First gearset 40*a* depicted in FIGS. 4A and 4B comprises a first gear 41*a* coupled to first rotation motor 30*a*. First gear 41*a* is coupled to second gear 42*a*, which is coupled to first magnet array 100*a* such that rotation of second gear 42*a* rotates first magnet array 100*a*. Second gear 42*a* is coupled to third gear 43*a*, which is rotatably coupled to first lateral support member 20*a*. Third gear 43*a* is coupled to fourth gear 44*a*, which is coupled to second magnet array 100*b* such that rotation of fourth gear 44*a* rotates second magnet array 100*b*.

Second gearset 40*b* operates similarly to rotate third magnet array 100*c* and fourth magnet array 100*d*. Second gearset 40*b* comprises a first gear 41*b* coupled to second rotation motor 30*b*. First gear 41*b* is coupled to second gear 42*b*, which is coupled to third magnet array 100*c* such that rotation of second gear 42*b* rotates third magnet array 100*c*. Second gear 42*b* is coupled to third gear 43*b*, which is rotatably coupled to second lateral support member 20*b*. Third gear 43*a* is coupled to fourth gear 44*a*, which is coupled to fourth magnet array 100*b* such that rotation of fourth gear 44*a* rotates second magnet array 100*b*. Second gearset 40*b* operates similarly to rotate third magnet array 100*c* and fourth magnet array 100*d*.

In the illustrated embodiment, two axles 106 are coupled to each magnet array and are configured to be received by the lateral support members and coupled to any of the gears or position indicators 22*a* or 22*b*. In other embodiments, axles 106 may be integral with each magnet array. In still other embodiments, axles 106 may be integral with any of the gears or the position indicator. And in still other embodiments, axles 106 may be integral with the lateral support members.

In alternate embodiments, only certain elements in a given magnet array may be configured to rotate, while other elements are configured to remain stationary. For example, in a magnet subarray 10, each second element 12 and each fourth element 14 may be configured to rotate 180 degrees about the axis of rotation, while first element 11 and third element 13 are configured to remain stationary. In this way, the max side 15 and the min side 16 of the magnet array can be reversed.

Figure 5A:
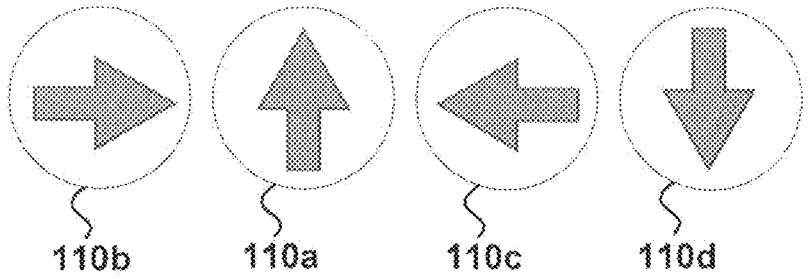
FIGS. 5A and 5B are end and top views, respectively, of uniform magnets in a planar configuration.
Figure 5B:
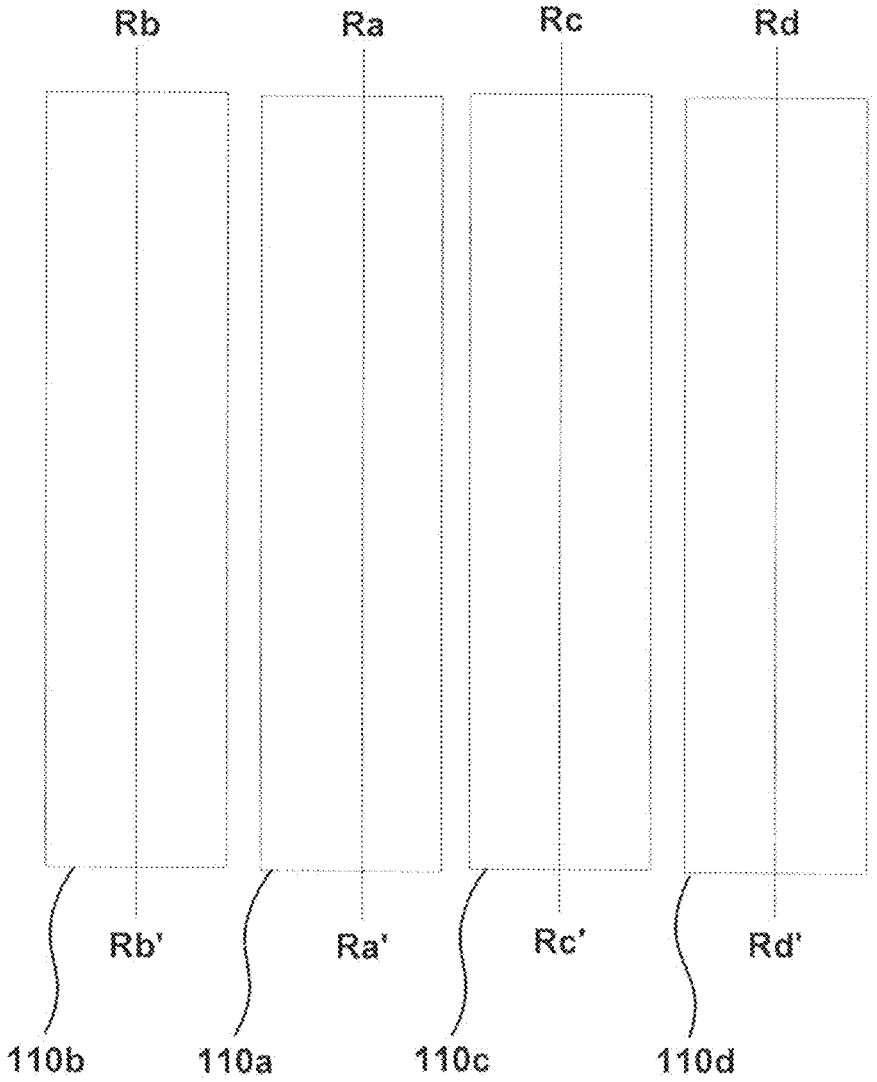

FIGS. 5A and 5B show specific embodiments of magnets for use in a magnetic actuator 50 (known as the "planar configuration"), in which uniform magnets are configured to rotate about an axis parallel to a central axis, e.g., an axis of symmetry. Uniform magnets are magnetized substantially uniformly through their width or height, that is, in a direction orthogonal to the axis of rotation. In some embodiments, the axis of rotation may be the axis of symmetry, e.g., the central axis of a cylinder, while in other embodiments, the axis of rotation may be offset from the axis of symmetry such that the magnet rotates eccentrically.

Illustrated embodiments of the planar configuration comprise first uniform magnet 110*a*, second uniform magnet 110*b*, third uniform magnet 110*c*, and fourth uniform magnet 110*d*. Other embodiments may comprise eight, twelve, sixteen, twenty or more uniform magnets 110.

As discussed in more detail below with respect to FIGS. 11-15, uniform magnets in the planar configuration generate a magnetic field that substantially covers a plane bounded by all the magnets. In other words, the magnetic field of each uniform magnet substantially extends between uniform magnets. In contrast, the magnetic field of the linear configuration is substantially confined to a plane defined by the surface the surface area of one magnet array 100 (e.g., the magnetic field of each magnet array 100 does not substantially extend between magnet arrays 100).

Each uniform magnet 110*a*, 110*b*, 110*c*, 110*d* may be configured to rotate 90 degrees about an axis parallel to its central axis in order to reverse the magnetic field, that is, to generate a magnetic field beneath the uniform magnets rather than above the uniform magnets. In the illustrated embodiment, first uniform magnet 110*a* is configured to rotate about first axis Ra-Ra'; second uniform magnet 110*b* is configured to rotate about second axis Rb-Rb'; third uniform magnet 110*c* is configured to rotate about Rc-Rc'; and fourth uniform magnet 110*d* is configured to rotate about fourth axis Rd-Rd'. As shown in FIG. 5B, first, second, third, and fourth axes of rotation are non-identical and each axis is substantially parallel to the others.

In this embodiment, adjacent uniform magnets are configured to rotate in opposite directions (i.e., second uniform magnet 110*b* and third uniform magnet 110*c* are configured to rotate clockwise 90 degrees and first uniform magnet 110*a* and fourth uniform magnet 110*d* are configured to rotate counterclockwise 90 degrees, or vice-versa). One of ordinary skill in the art would understand that gearsets 40*a* and 40*b* of actuator 50 shown in FIGS. 4A and 4B may be modified to accomplish this type of rotation.

In another embodiment, only non-adjacent uniform magnets are configured to rotate, and these magnets are configured to rotate 180 degrees. For example, in some embodiments, first uniform magnet 110*a* and fourth uniform magnet 110*d* are configured to rotate 180 degrees in order to reverse the magnetic field. In other embodiments, second uniform magnet 110*b* and third uniform magnet 110*c* are configured to rotate 180 degrees. One of ordinary skill in the art would understand that gearsets 40*a* and 40*b* of actuator 50 shown in FIGS. 4A and 4B may be modified (such as by adding or subtracting gears from the gearset) to accomplish this type of rotation.

Assay Preparation Module

FIGS. 6A-9 are isometric views of an assay preparation module 200, which is one embodiment of the present systems configured to isolate particles in a fluid assay. Module 200 comprises magnetic actuator 50.

Figure 6B:
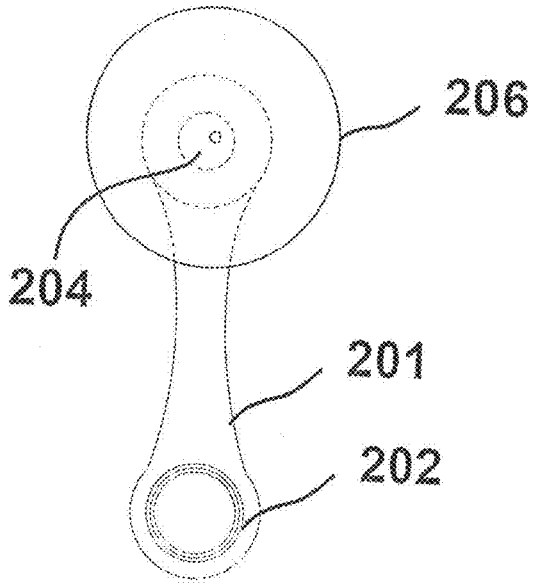
FIG. 6B is a top view of an embodiment of an agitator motor coupled to a link of the embodiment of FIG. 6A.
Figure 6A:
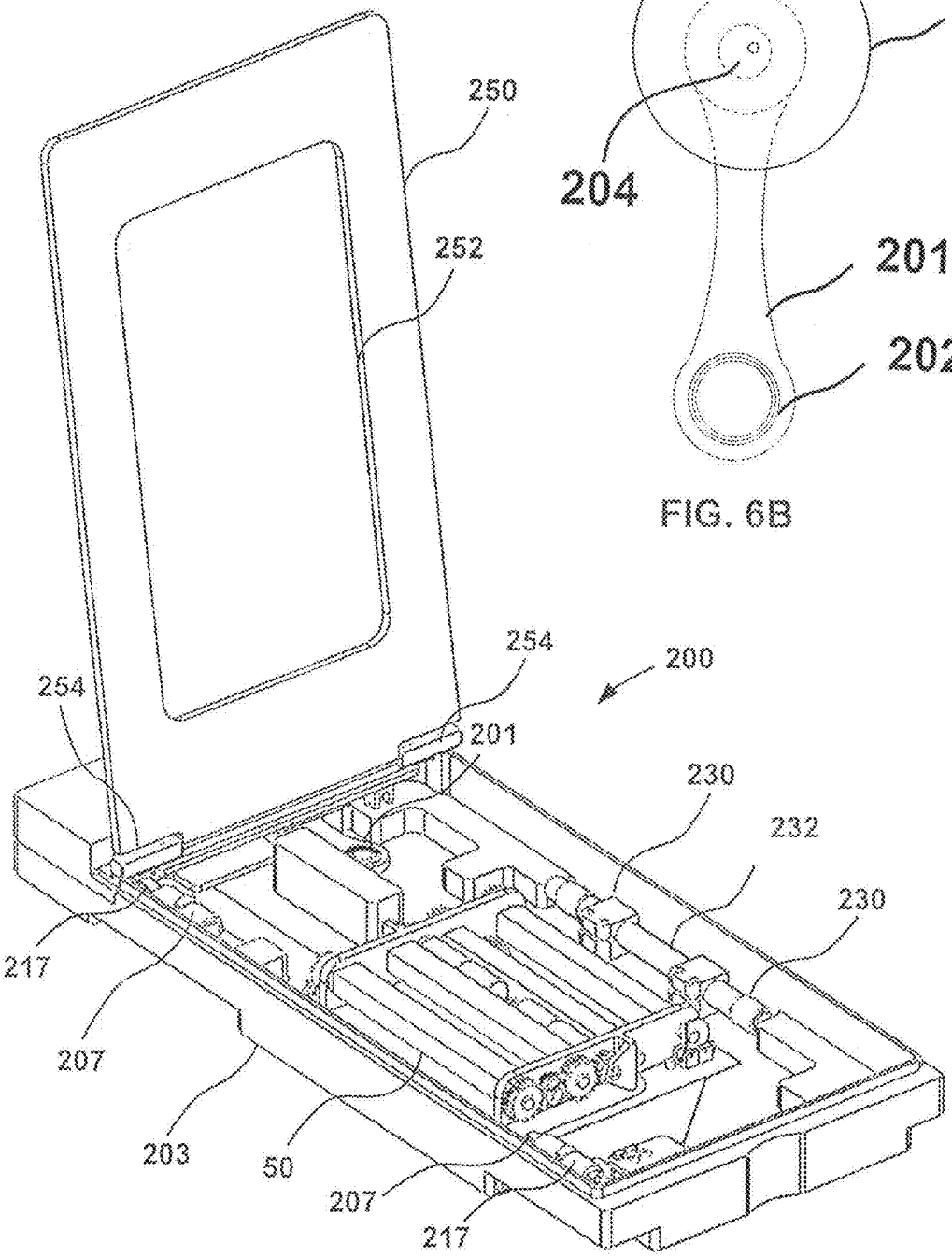
FIG. 6A is a perspective view of an embodiment of an assay preparation module showing the chassis and the embodiment of FIGS. 4A and 4B.
Figure 7:
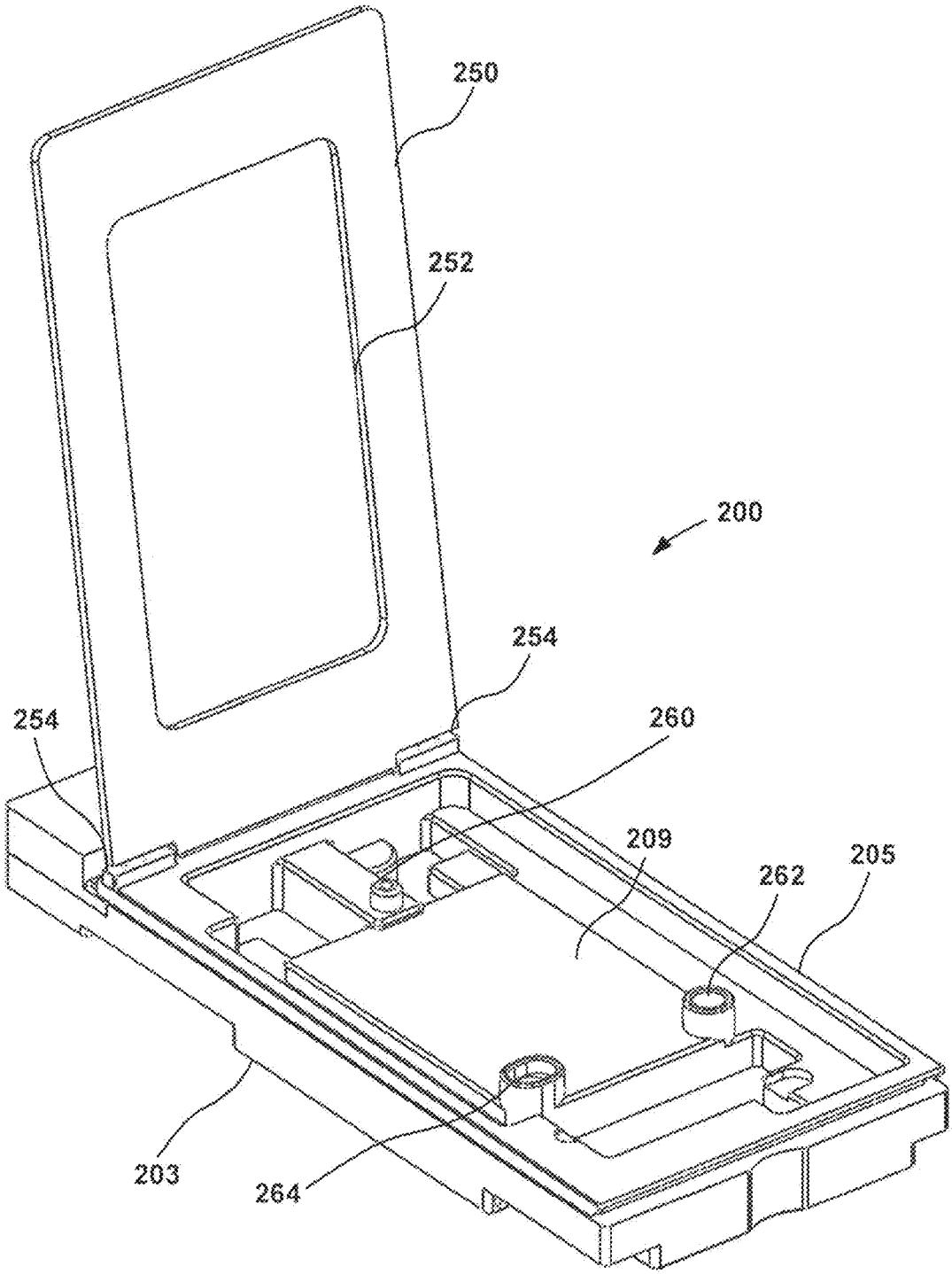

As shown in FIG. 6A, assay preparation module 200 comprises chassis 203 configured to be coupled to a tub 205 (shown in FIG. 7). In the illustrated embodiment, module 200 also includes lid 250, which is coupled to chassis 203 with hinges 254 that allow lid 250 to open and close. Lid 250 may be held closed with known latching mechanisms (e.g., a magnetic or electromagnetic latch, a clip, a tab and slot, etc.). Lid 250 is configured to retain at least a portion of tub 205 and/or well plate 210—also parts of module 200—while allowing access to reaction wells 220 of well plate 210. In the illustrated embodiment, lid 250 comprises window 252. In the preferred embodiment, window 252 is open and configured to allow access to a plurality of reaction wells 220 when lid 250 is in the down position (e.g., to allow fluids to be dispensed to one or more wells 220). In other embodiments, window 252 may be covered in a light-permeable material, where "light" includes the visible spectrum as well as ultraviolet light and infrared light.

Chassis 203 is configured to support embodiments of actuator 10 as discussed above. In some embodiments, actuator 50 may be coupled to chassis 203 via screws, adhesive, tabs and slots, ultrasonic welding, or other known joining methods. In other embodiments, portions of actuator 50 such as lateral support members 20*a* and 20*b*, may be integral to or form a portion of chassis 203. In addition, as shown the illustrated embodiment, chassis 203 also comprises an agitator motor 206 coupled to a link 201 (shown in FIG. 6B), two floating rails 217, and fixed rail 232. Each floating rail 217 is coupled to chassis 203 and to a bushing 207. The fixed rail 232 is coupled to chassis 203 via rail supports 230 in the embodiment shown.

In the illustrated embodiment of assay preparation module 200, agitator motor 206 is configured to agitate (e.g., shake, vibrate, oscillate, etc.) tub 205 via link 201 upon receiving an electric signal. In a preferred embodiment, link 201 contains an eccentric cam 204 fixed to the shaft of agitator motor 206 that is configured to convert rotation motion of agitator motor 206 into linear displacement of link 201 relative to agitator motor 206. In certain embodiments, link 201 can be configured for a maximum relative displacement of between about 0.25 mm and about 5.0 mm. Agitator motor 206 is configured for a rotational speed of between about 10 RPM and about 1800 RPM in particular embodiments.

FIG. 7 shows an embodiment of assay preparation module 200 with tub 205 coupled to chassis 203. Link 201 is configured to receive a portion of tub 205 and transfer reciprocating force to tub 205; in particular, link 201 includes opening 202 that is configured to receive a portion of tub 205, such as a post or tab or other protrusion from the underside of tub 205. In various embodiments, tub 205 comprises holes, slots, channels, or other features that are configured to receive at least a portion of floating rails 217 and bushings 207, as well as a portion of fixed rail 232. In certain embodiments, bushings 207 may be coupled to tub 205 such as with a force fit.

In the embodiment shown, fixed rail 232 is configured to vertically support tub 205 and allow tub 205 to move in substantially one direction, such as back and forth along the length of fixed rail 232. Clearance exists between tub 205 and chassis 203 such that tub 205 may move relative to chassis 203. In this embodiment, floating rails 217 and bushings 207 are slidably retained within tub 205 and are configured to vertically support tub 205 and allow tub 205 to move in substantially two directions—longitudinally along length of rails 217 and laterally perpendicularly to the longitudinal and vertical directions. In the illustrated embodiment, each bushing 207 is configured to be coupled to tub 205 and further configured to move longitudinally relative to each floating rail 217.

Tub 205 is configured to be coupled to well plate 210, in particular embodiments, tub 205 comprises a circular slot 262 and an elliptical slot 264. Each slot is configured to receive a portion of well plate 210 such as posts or tabs or other protrusions from the underside of well plate 210.

The illustrated embodiment of tub 205 also comprises orientation post 260, which is configured to receive a portion of well plate 210 and/or be received by well plate 210. Orientation post 260 and/or slots 262 and 264 may comprise a sensor (e.g., a capacitive sensor, not shown) configured to detect the position of tub 205. For example, the sensor may be configured to detect that tub 205 is tilted, skewed, or otherwise misaligned, and send a signal to a processor indicating the position of tub 205 relative to the instrument containing the assay preparation module. Additionally, the sensor or sensors coupled to orientation post 260 and/or slots 262 and 264 may be configured to detect the presence of well plate 210.

In the embodiment shown, tub 205 comprises a well plate platform 209 upon which a well plate 210 (shown in FIG. 8) may be placed for additional vertical support. When well plate 210 is placed on, coupled to, or otherwise located on well plate platform 209, well plate 210 is considered to be adjacent to magnetic actuator 50.

In certain embodiments, tub 205 or portions of tub 205 (e.g., well plate platform 209) may comprise aluminum or another material configured to allow capacitive sensing.

Figure 8:
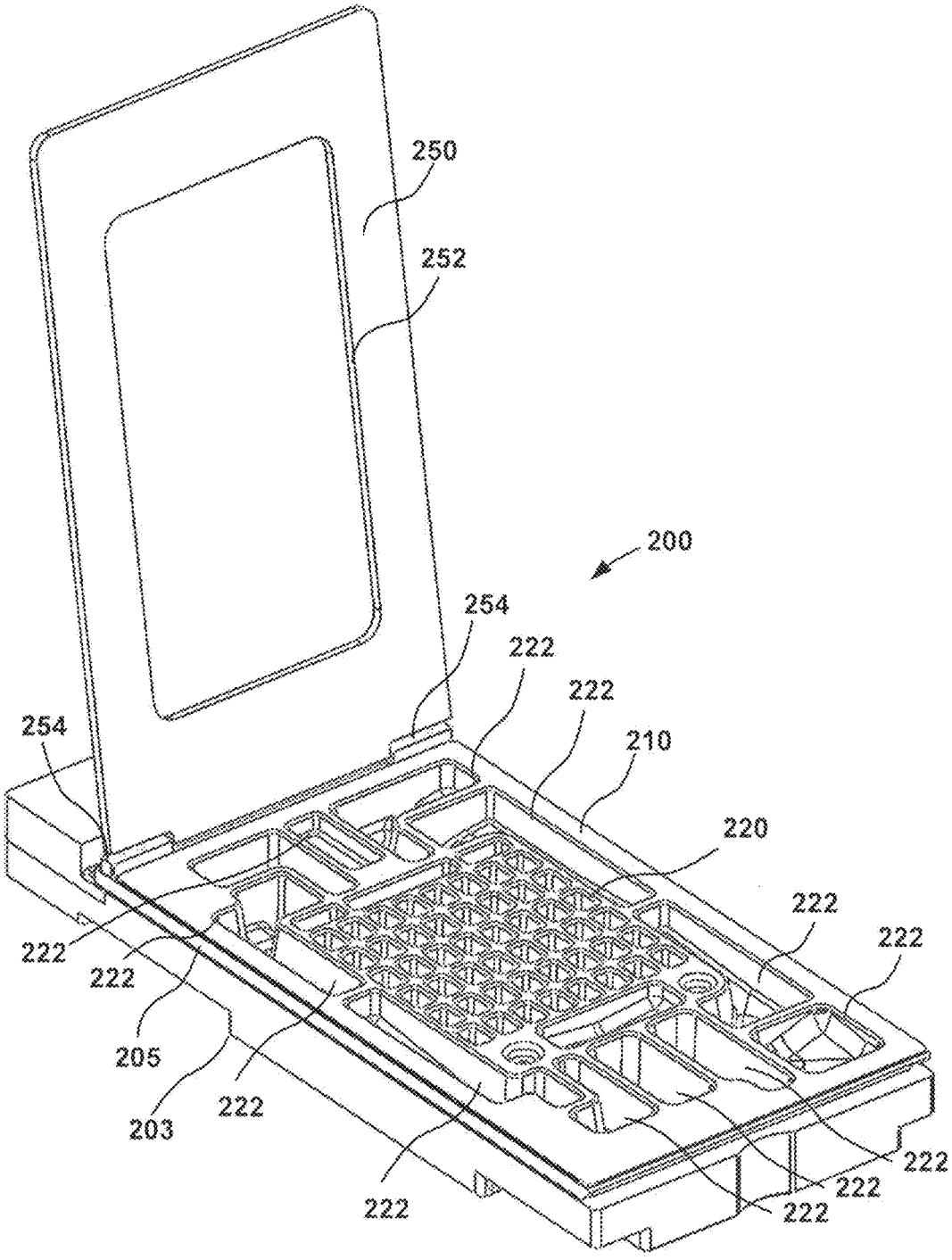
Figure 9:
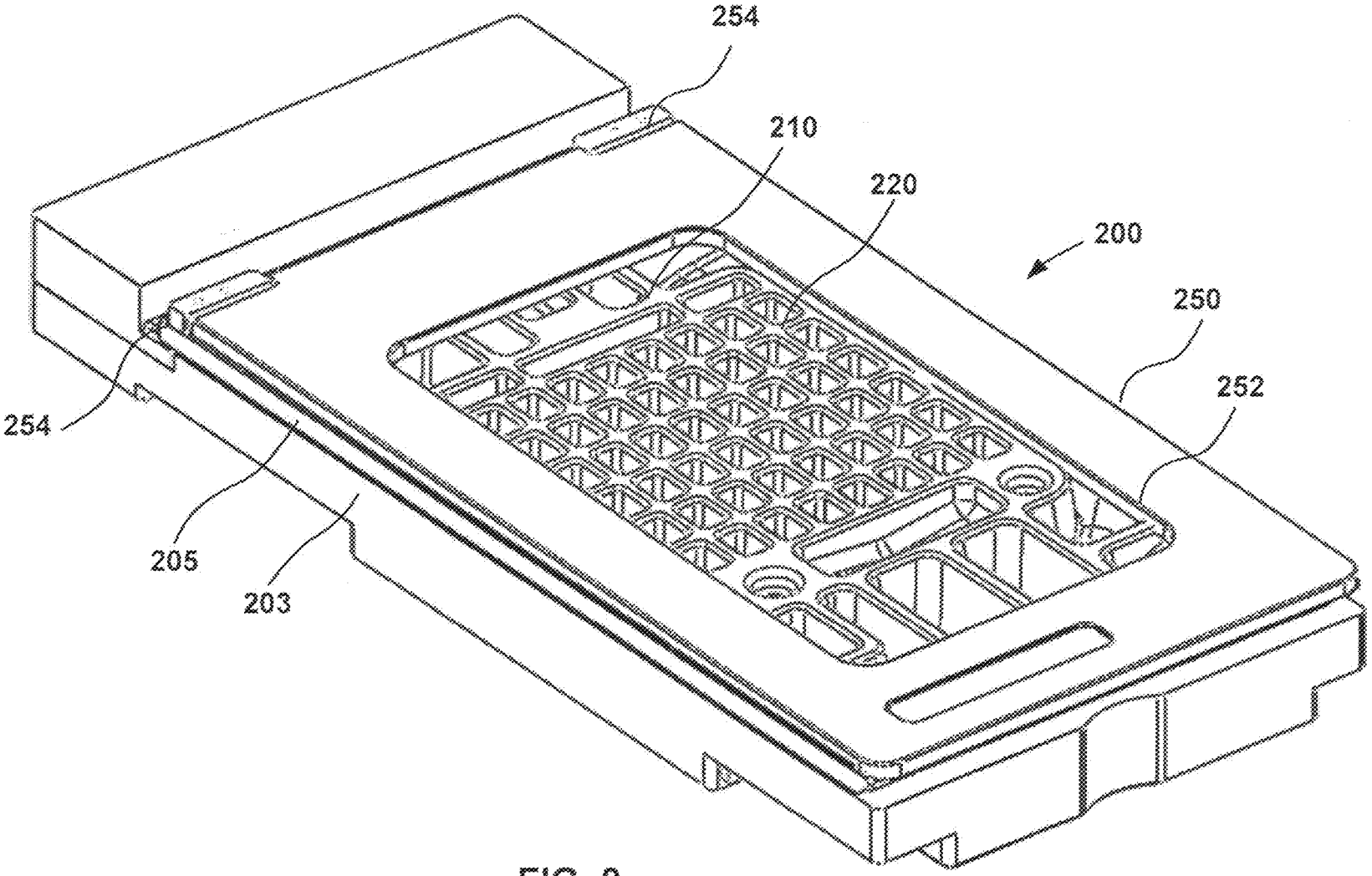

FIG. 8 shows an embodiment of assay preparation module 200 with well plate 210 coupled to tub 205 and chassis 203. The illustrated embodiment of well plate 210 comprises a plurality of reaction wells 220 as well as a plurality of reservoirs 222. FIG. 9 shows an embodiment of assay preparation module 200 with lid 250 in the down position with reaction wells 220 visible through window 252.

Figure 10:
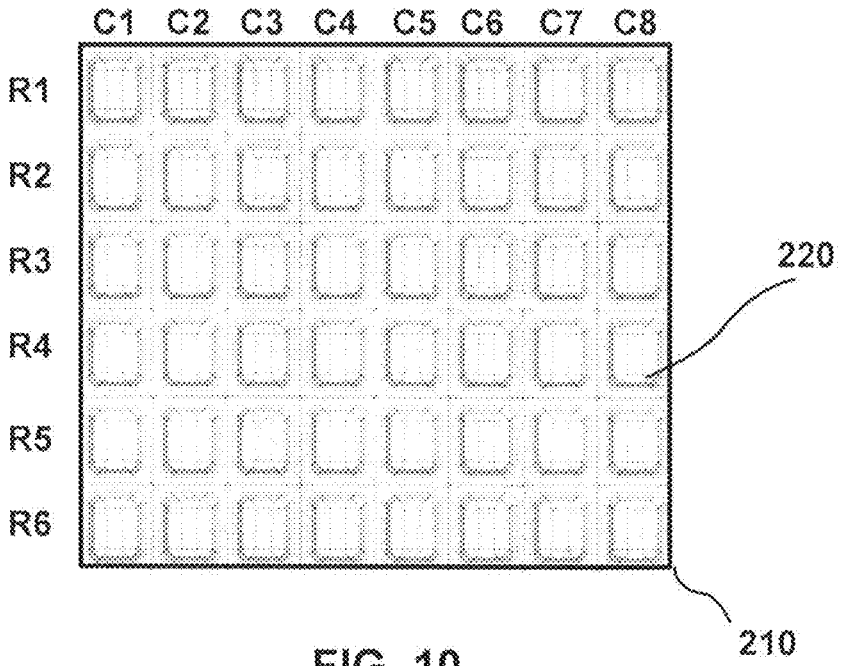

FIG. 10 is a detail view of well plate 210 that comprises a plurality of wells 220. Embodiments of well plate 210 may comprise forty-eight wells (eight columns C1-C8 by six rows R1-R6). Other embodiments of well plate 210 may comprise ninety-six, one hundred ninety-two, or some other number of reaction wells 220.

Operation of Magnetic Actuator

Figure 11:
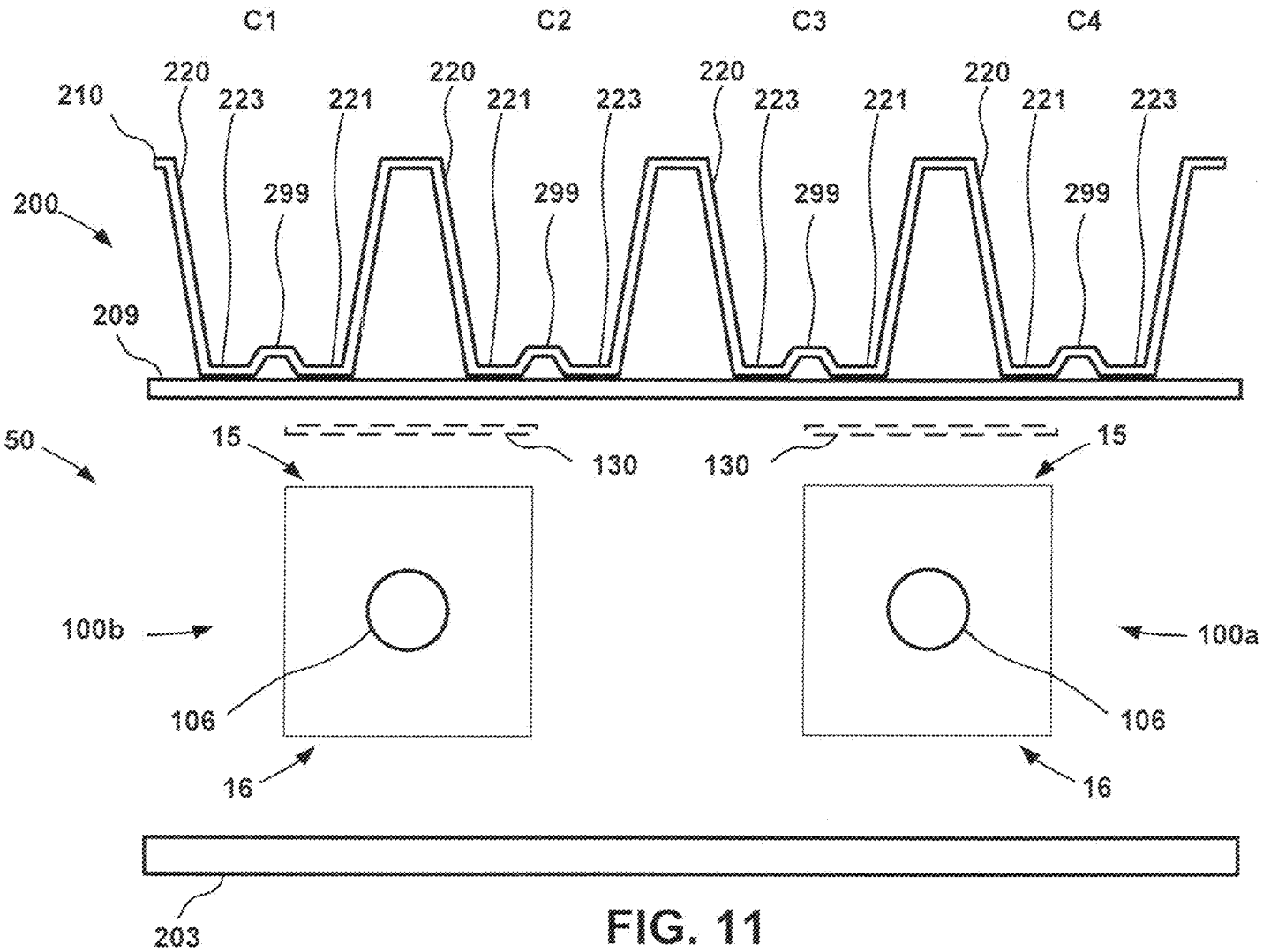
FIG. 11 is a schematic illustration of an end view of a portion of the embodiment of FIG. 8 showing magnet arrays in a first position.
Figure 12:
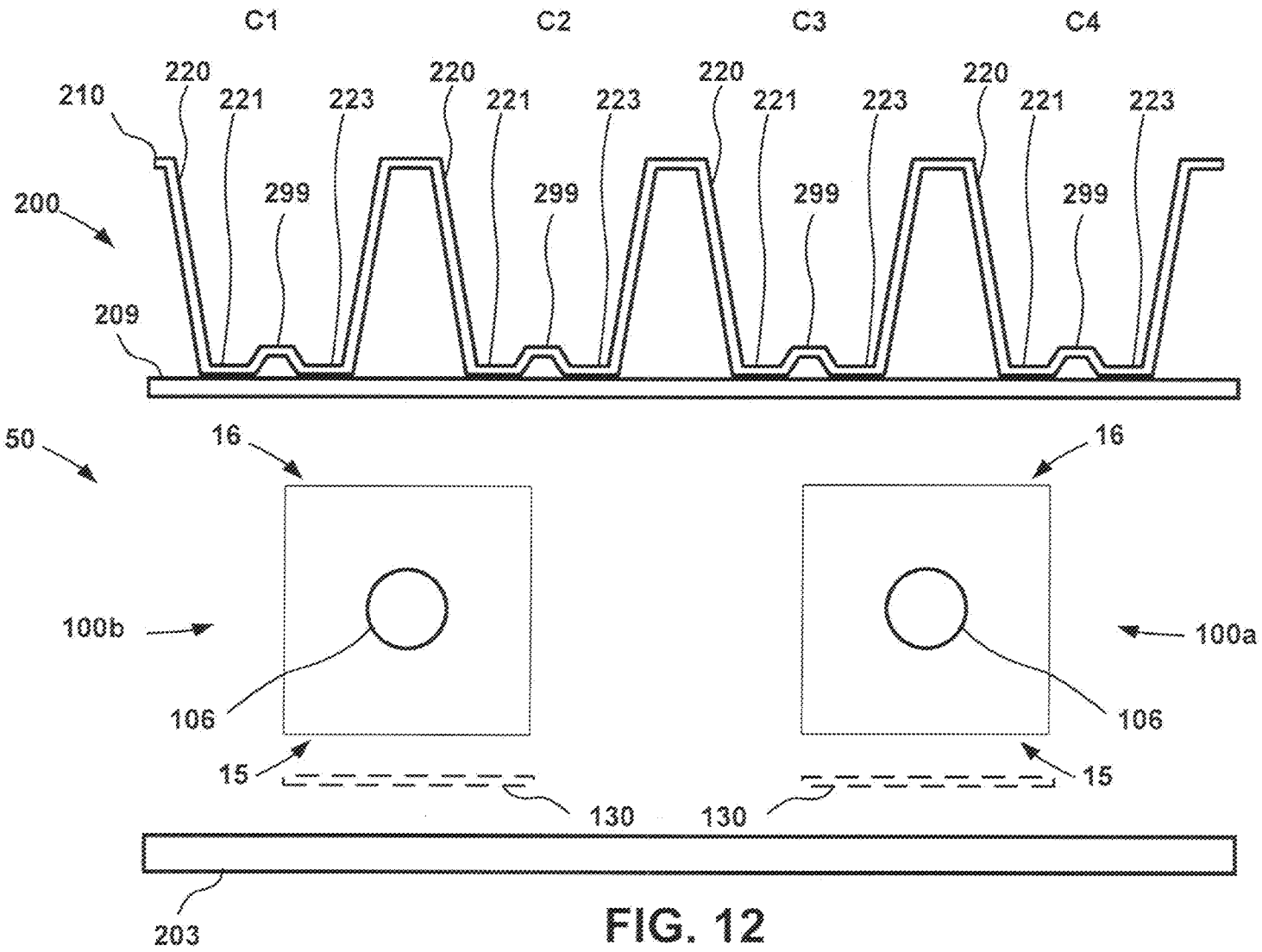
FIG. 12 is a schematic illustration of an end view of a portion of the embodiment of FIG. 8 showing magnet arrays in a second position.

FIGS. 11 and 12 are schematic illustrations of the linear configuration of magnetic actuator 50 configured for use in an assay preparation module 200, shown in end view. Support and gear elements are not shown for clarity, and these embodiments depict only two magnet arrays 100*a* and 100*b*. In other embodiments, however, only one magnet array may be used or there may be three, four, five, six, seven, eight, nine, ten, eleven, twelve or more magnet arrays.

Magnetic actuator 50 is depicted within assay preparation module 200. A partial well plate 210 is shown supported by well plate platform 209.

In certain exemplary embodiments shown in FIGS. 11 and 12, the linear configuration of magnetic actuator 50 is configured for use with an embodiment of well plate 210 in which each well 220 comprises a proximal trench 221 (the trench closest to a given magnet array) and a distal trench 223 (the trench furthest from a magnet array) separated by a ridge 299. In other embodiments, wells 220 may have a flat bottom, a U-shaped bottom, a V-shaped bottom, a rounded bottom, or any other suitable profile.

In the illustrated embodiment, well plate 210 is configured to be placed above magnetic actuator 50 on well plate platform 209 in assay preparation module 200 such that each magnet array 100 is adjacent and substantially parallel to two columns of wells 220. For example, second magnet array 100*b* may be adjacent and substantially parallel to columns C1 and C2, first magnet array 100*a* may be adjacent and substantially parallel to columns C3 and C4, third magnet array 100*c* may be adjacent and substantially parallel to columns C5 and C6, and fourth magnet array 100*d* may be adjacent and substantially parallel to columns C7 and C8. In this configuration, a pellet of magnetic particles (not shown) may be formed substantially in each proximal trench nearest the corresponding magnet array, while the fluid may be aspirated from each distal trench furthest from the corresponding magnet array.

In other embodiments, magnet arrays may be adjacent and substantially parallel to two rows of wells (rather than two columns of wells as described above). In still other embodiments, a magnet or magnet array may correspond to each row R or column C of wells 220. In still other embodiments, a magnet or magnet array may correspond to each individual well 220.

In FIG. 11, magnetic actuator 50 is shown in a first position (e.g. the "max state") adjacent to a portion of well plate 210. Second magnet array 100*b* is shown adjacent and substantially parallel to columns C1 and C2, while first magnet array 100*a* is shown adjacent and substantially parallel to columns C3 and C4. In the first position, magnet arrays are positioned (e.g., have been rotated about an axis) such that the max side of each array is closer to the wells in a given column or pair of columns than the min side is. While in the first position, each magnet array applies a magnetic field (schematically represented as magnetic field 130) to wells 220. In the embodiments shown in FIGS. 11 and 12, a stronger magnetic force is exerted on proximal trenches 221 than is exerted on distal trenches 223.

In FIG. 12, magnetic actuator 50 is shown in a second position (e.g. the "min state") adjacent to a portion of well plate 210. Second magnet array 100*b* is shown adjacent and substantially parallel to columns C1 and C2, while first magnet array 100*a* is shown adjacent and substantially parallel to columns C3 and C4. In the min state, magnet arrays 100 are positioned such that the min side is closer to the wells than the max side is and magnetic field 130 is moved away from reaction wells 220.

While in the second position, each magnet array 100 applies a smaller magnetic field to wells 220 than when in the first position. In certain embodiments, the magnetic field applied to wells 220 in the min state may be zero or so small as to exert no detectable effect on the contents of wells 220.

In certain embodiments of the present actuators the motors are configured to rotate the magnet arrays (or selected magnets in each magnet array) such that each magnet array is either in the first position (which may be considered the "on" position) or the second position (which may be considered the "off" position). Such embodiments may be referred to as having a "binary" configuration. In other embodiments of the present actuators, the motors are configured to rotate the magnet arrays (or selected magnets in each magnet array) such that each magnet array can produce a magnetic field anywhere between and including the first and second positions. Such embodiments may be referred to as having an analog configuration.

Referring back to the embodiment of the present actuators shown in FIGS. 4A and 4B, rotation motor 30*a* is configured to rotate first gear 41*a* clockwise, which rotates second gear 42*a* and first magnet array 100*a* counterclockwise. ("Clockwise" and "counterclockwise" are relative terms; here, the viewer is presumed to be looking at magnetic actuator 50 from an end such that a given gearset that rotates the magnet array is between the viewer and the magnet array). Second gear 42*a* rotates third gear 43*a* clockwise, which rotates fourth gear 44*a* and second magnet array 100*b* counterclockwise. In this manner, magnet arrays are configured to rotate counterclockwise away from motor to minimize magnetic interference. In other words, when a given magnet array is rotating, the min side is closer (or equally as close) to a motor than the max side. In other embodiments, magnet arrays may be configured to rotate independently from one another. In still other embodiments, three, four, five, six, seven, eight, nine, ten, eleven, twelve, or more magnet arrays may be coupled to the same gearset such that all magnet arrays coupled to a given gearset can be rotated together.

In the illustrated embodiment, the magnet array of actuator 50 furthest from the rotation motor to which it is coupled is coupled to a position indicator. Thus, in the embodiment shown, second magnet array 100*b* is coupled to first position indicator 22*a* and fourth magnet array 100*d* is coupled to second position indicator 22*b*. The position indicator rotates with the magnet array to which it is coupled and is located adjacent to two sensors—left sensor 21*b* and right sensor 23*b*; though not shown, comparable left and right sensors may be positioned in the same respective locations with respect to first position indicator 22*a*. Left sensor 21*b* and right sensor 23*b* are coupled to a processor and are configured to send a signal to the processor when the sensor is tripped. In various embodiments, one sensor may be used, or three or more sensors may be used. In various embodiments, a photointerrupter, a fiber optic sensor, a reflective optical sensor, an encoder, a mechanical switch, a Hall effect sensor, a magnetic field sensor, or other suitable binary position sensors known to those of ordinary skill in the art may be used for each sensor.

In the illustrated embodiment, sensors 21*b* and 23*b* are photointerruptor-type sensors. Each sensor is configured to emit a beam of light from an emitter and is configured to receive the beam with a receiver. In the embodiment shown, a sensor is "occluded" when the beam is not allowed to pass from the emitter to the receiver, e.g., is blocked with a position indicator. A sensor is "not occluded" when the beam is allowed to pass from the emitter to the receiver.

Thus, together with the sensors, the position indicators may be used to indicate the state of each of a given magnet array or a given pair of magnet arrays. In the illustrated embodiment, each magnet array has one of three possible states: a max state, a min state, and an intermediate state between the max and min state. The two sensors associated with each position indicator each have two possible states (occluded and not occluded), thus allowing four possible state combinations. In the configuration shown, the state in which both sensors are not occluded is not possible since the magnets are configured to rotate only about 180 degrees. Therefore, the three possible sensor states are able to uniquely identify the three possible magnet states of min, max, and intermediate.

For example, in the illustrated embodiment, when left sensor 21*b* is not occluded and sensor 23*b* is occluded, magnet arrays 100*c* and 100*d* are in the max state. When right sensor 23*b* is not occluded, and left sensor 21*b* is occluded, magnet arrays 100*c* and 100*d* are in the min state. When both left sensor 21*b* and right sensor 23*b* are occluded, magnet arrays 100*c* and 100*d* are moving between the max and min states and are in the intermediate state. In FIGS. 4A and 4B, third magnet array 100*c* and fourth magnet array 100*d* are shown in the min state. Accordingly, second position indicator 22*b* is shown with right sensor 23*b* not occluded and left sensor 21*b* occluded.

In other embodiments, position indicator 22 may not be necessary and only one sensor (rather than the two sensors shown) may correspond to each magnet array or synchronously rotating set of magnet arrays. In such embodiments, the sensor may be a variable position sensor configured to indicate the position of each set of magnet arrays. The position of each set of magnet arrays corresponds to the strength of the magnetic field those magnets exert on wells 220. Accordingly, in such embodiments, each sensor may be tuned to a precise intermediate position between the max state and the min state. In such embodiments, sensors may include rheostats, encoders, Hall effect sensors, potentiometers, (or other suitable variable position sensors known to those of ordinary skill in the art).

Figure 13:
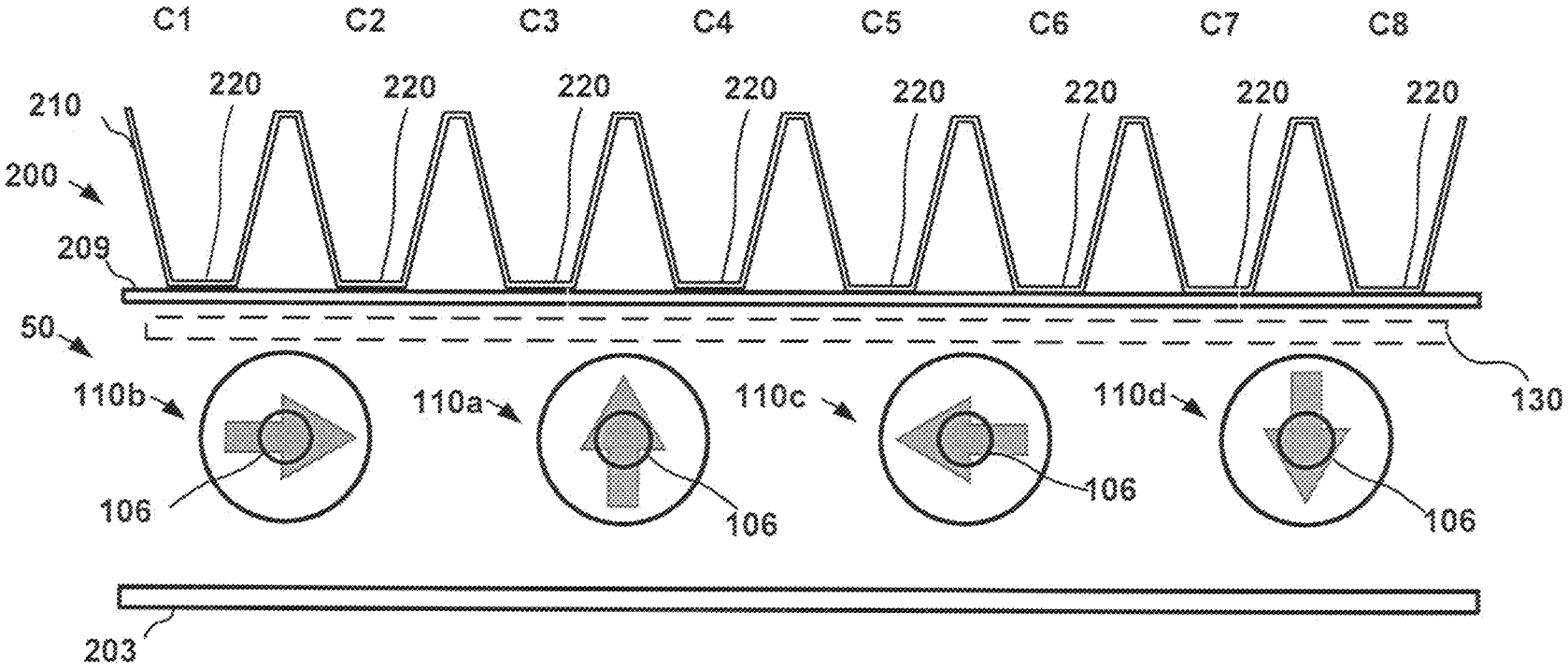
FIG. 13 is a schematic illustration of an embodiment of an assay preparation module and a well plate showing uniform magnet arrays in a first position.
Figure 14:
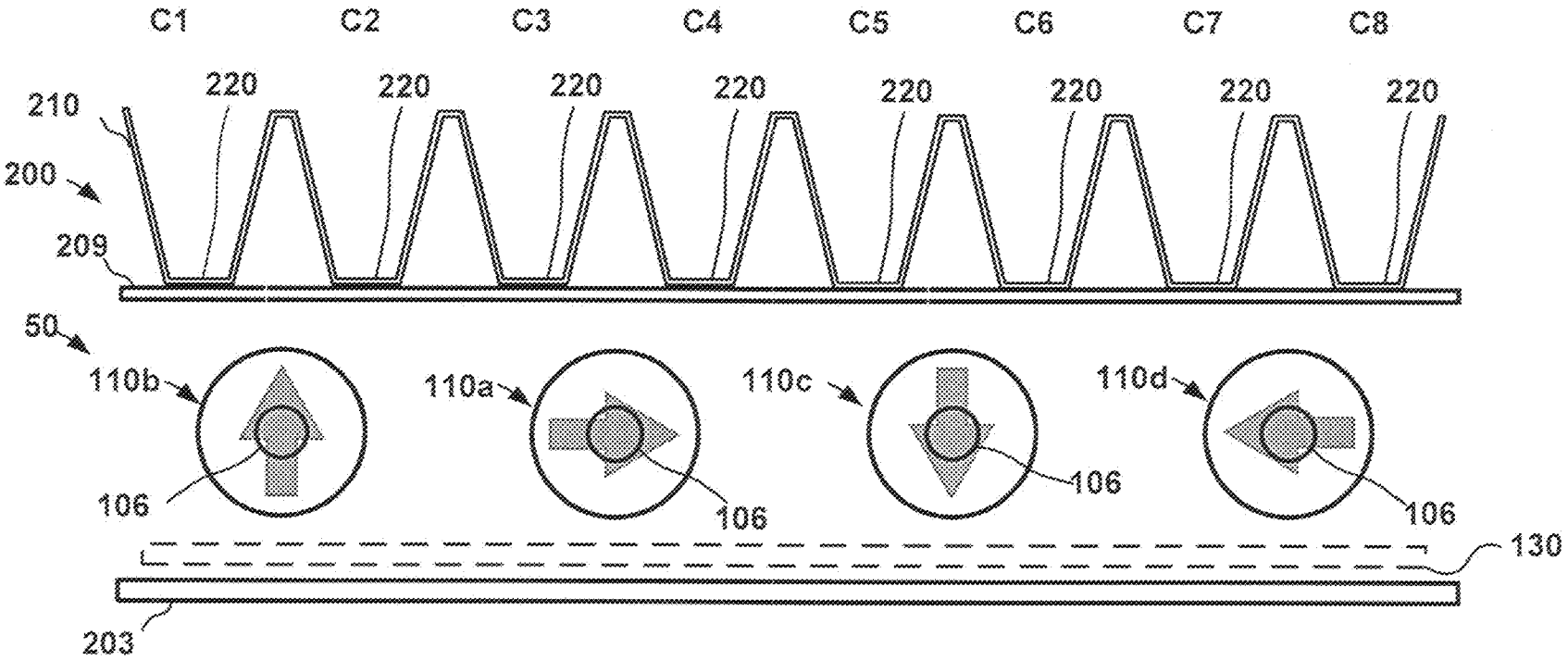
FIG. 14 is a schematic illustration of an embodiment of an assay preparation module and a well plate showing uniform magnet arrays in a second position.
Figure 15:
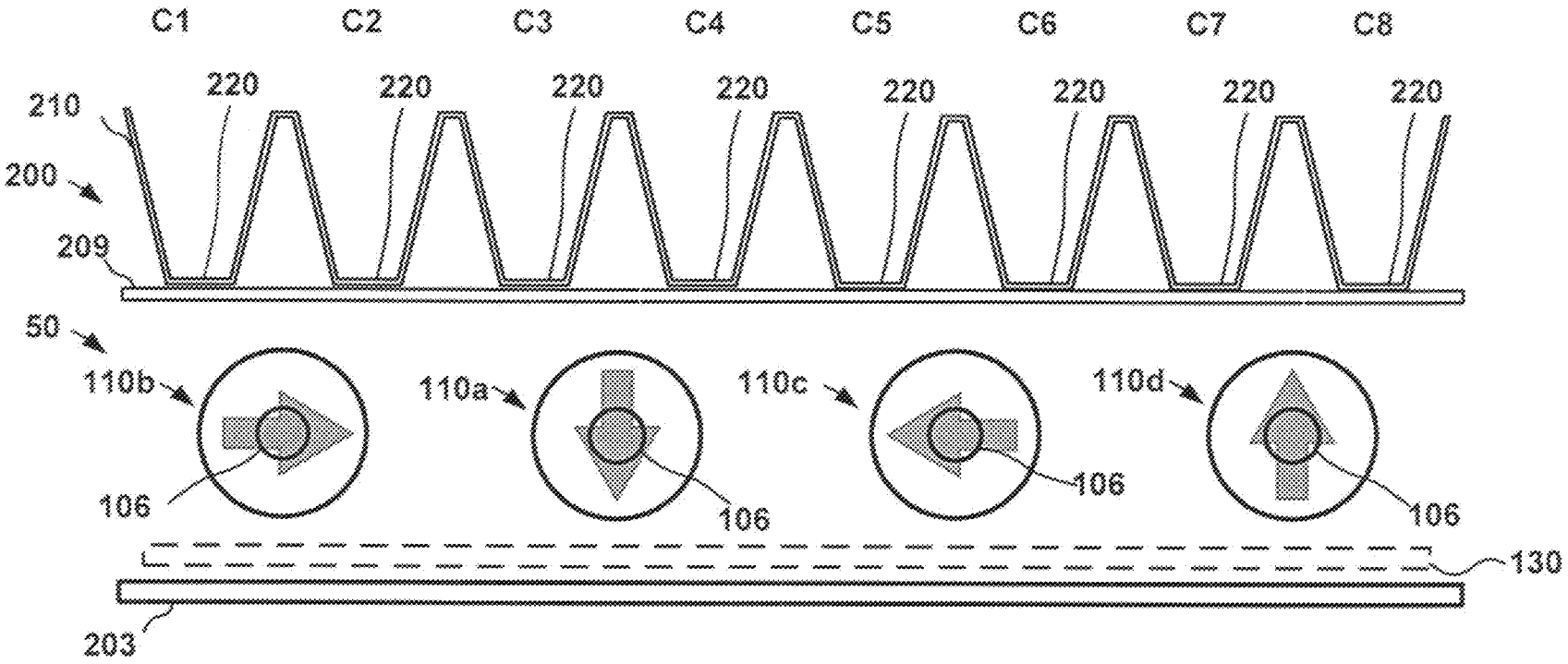
FIG. 15 is a schematic illustration of an embodiment of an assay preparation module and a well plate showing uniform magnet arrays in a third position

FIGS. 13-15 illustrate an alternate embodiment in which a planar configuration of actuator 50 is used. In exemplary embodiments, the planar configuration of actuator 50 is configured for use with a well plate 210 comprising a plurality of reaction wells 220 that may be flat-bottomed, U-shaped, V-shaped, or some other suitable shape lacking a ridge and trenches.

In the illustrated embodiment, well plate 210 is configured to be placed above magnetic actuator 50 in assay preparation module 200 (e.g., on well platform 209 as shown in FIG. 7) such that each uniform magnet is adjacent and substantially parallel to two columns of wells 220.

For example, second uniform magnet 110*b* may be adjacent and substantially parallel to columns C1 and C2, first uniform magnet 110*a* may be adjacent and substantially parallel to columns C3 and C4, third uniform magnet 110*c* may be adjacent and substantially parallel to columns C5 and C6, and fourth uniform magnet 110*d* may be adjacent and substantially parallel to columns C7 and C8.

In other embodiments, uniform magnets 110 may be adjacent and substantially parallel to two rows of wells 220 (rather than two columns of wells as described above). In still other embodiments, each row R or column C of wells 220 may have a corresponding uniform magnet 110.

Figure 3B:
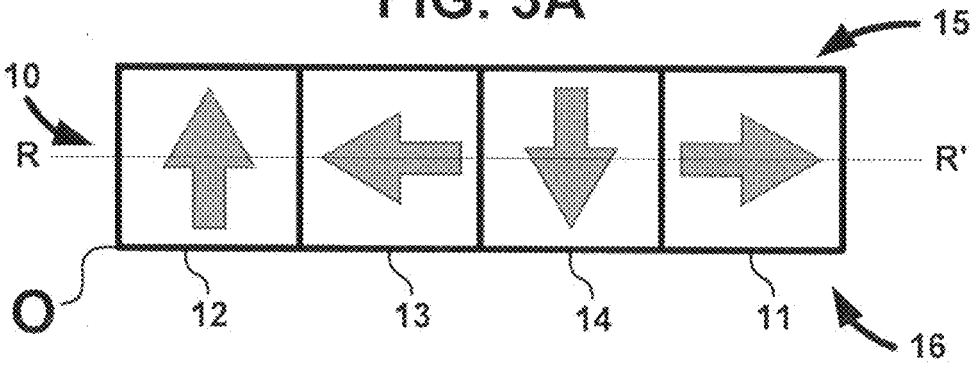
Figure 3C:
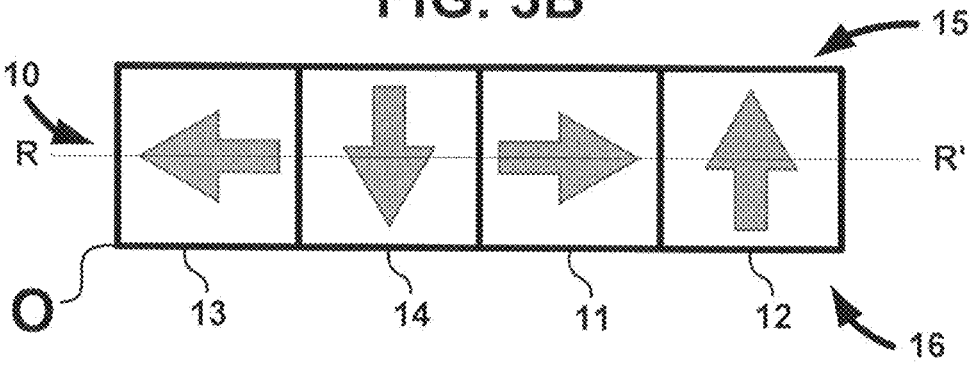
Figure 3D:
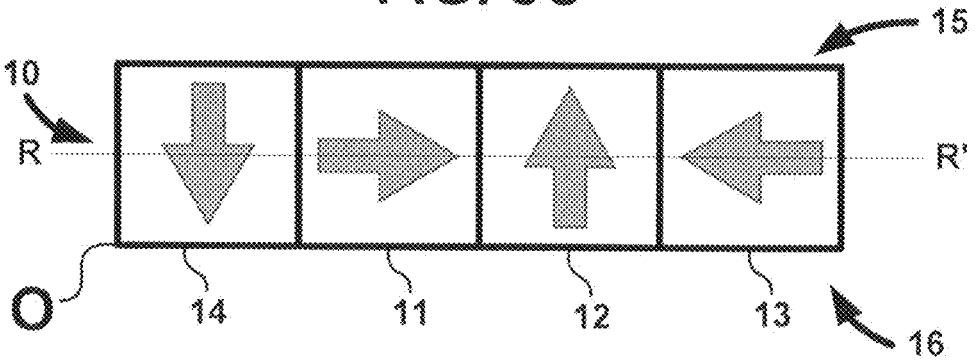

In FIG. 13, magnetic actuator 50 is in a first position corresponding with the "max state" adjacent to a portion of well plate 210. In the first position, the uniform magnets are arranged relative to one another to induce a magnetic field 130 substantially on the side of uniform magnets nearest wells 220. As shown in FIG. 13, uniform magnets 110 are arranged in the same order as the magnetic elements in FIG. 3A; one of ordinary skill in the art would understand that uniform magnets may be arranged as shown in FIGS. 3B-3D in alternate embodiments. In the illustrated embodiment, each uniform magnet 110 is configured to rotate about an axis substantially parallel to the axis of rotation of each other uniform magnet 110.

In FIG. 14, magnetic actuator 50 in a second position corresponding with the "min state." In this embodiment, each uniform magnet depicted in FIG. 13 is configured to rotate 90 degrees in the opposite direction of any adjacent uniform magnet to adjust the array from the first position to the second position. In the second position, a magnetic field 130 is induced substantially on the side of uniform magnets furthest from the wells. For example, in the illustrated embodiment, second magnet 110*b* and third magnet 110*c* are configured to rotate 90 degrees counterclockwise, while first magnet 110*a* and fourth magnet 110*d* are configured to rotate 90 degrees clockwise. In alternate embodiments, second magnet 110*b* and third magnet 110*c* may be configured to rotate 90 degrees clockwise, while first magnet 110*a* and fourth magnet 110*d* are configured to rotate 90 degrees counterclockwise.

In FIG. 15, another embodiment of actuator 50 is in a third position corresponding with the "min state." In this embodiment, non-adjacent uniform magnets 110 depicted in FIG. 13 are configured to rotate 180 degrees to adjust the array from the max state to the min state. In this embodiment, first uniform magnet 110*a* and fourth uniform magnet 110*d* may be configured to rotate 180 degrees. In alternative embodiments, second uniform magnet 110*b* and third uniform magnet 110*c* may be configured to rotate 180 degrees.

Figure 16:
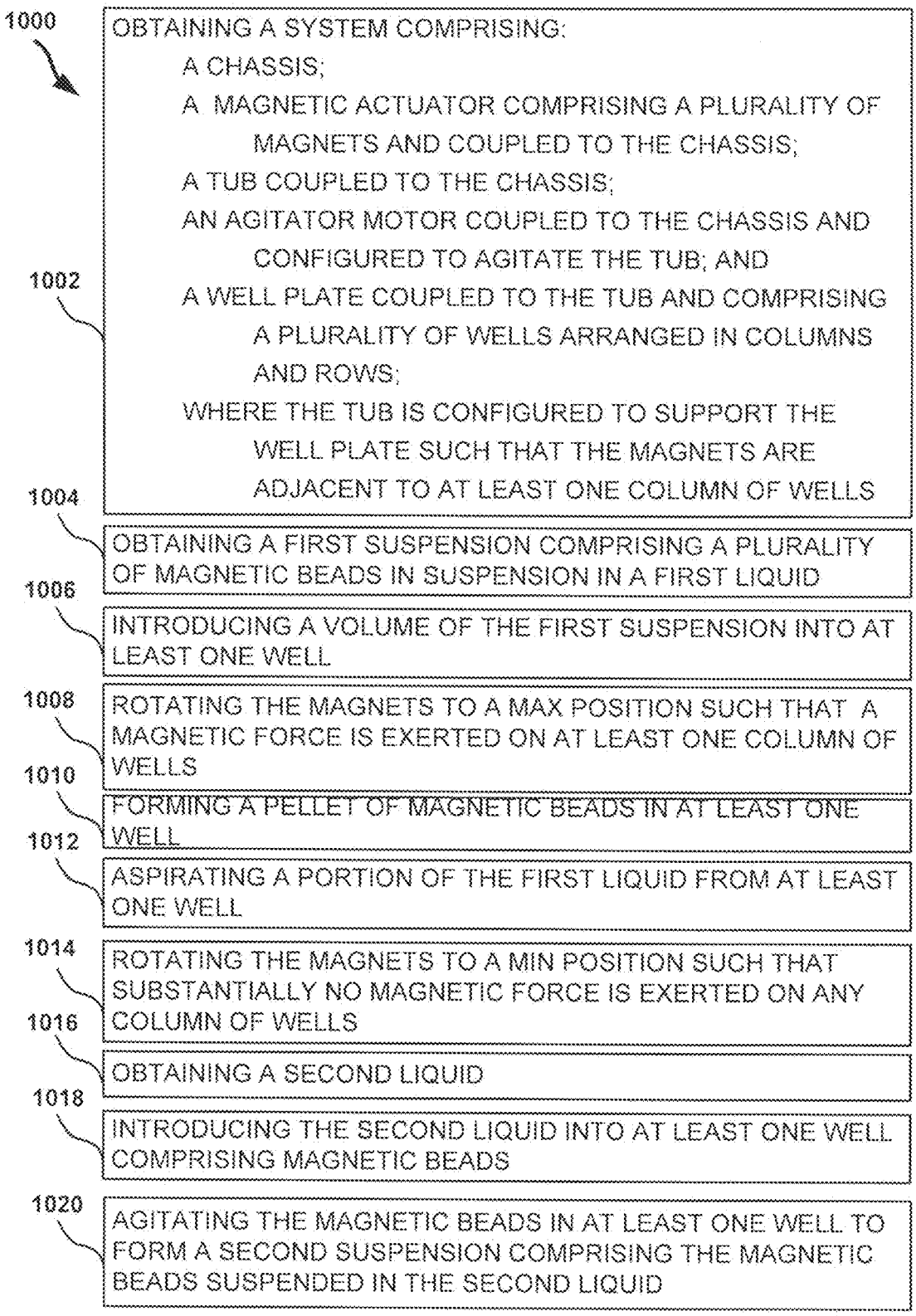
FIG. 16 is an embodiment of a method for collecting a sample of magnetic particles from a liquid.

FIG. 16 illustrates steps of an embodiment of a method 1000 for collecting a sample of magnetic particles from a liquid. Step 1002 comprises obtaining a system comprising: a chassis; a magnetic actuator coupled to the chassis comprising a plurality of magnets; a tub coupled to the chassis; a magnetic actuator comprising a first magnet array and coupled to the chassis, where the first magnet array has an axis of rotation along its length; a motor coupled to the first magnet array and configured to rotate the first magnet array about its axis of rotation; an agitator motor coupled to the chassis and configured to agitate the tub; a well plate comprising a plurality of wells arranged in columns and rows; where the tub is configured to support the well plate such that each magnet is adjacent to at least one column of wells. Step 1004 comprises obtaining a first suspension comprising a plurality of magnetic particles in suspension in a first liquid. Step 1006 comprises introducing a volume of the first suspension into at least one well. Step 1008 comprises rotating the magnet arrays to a max state such that each permanent magnet exerts a magnetic force on at least one column of wells. Step 1010 comprises forming a pellet of magnetic particles in at least one well. Step 1012 comprises aspirating a portion of the first liquid from at least one well. Step 1014 comprises rotating the magnet array to a min state such that substantially no magnetic force is exerted on any column of wells. Step 1016 comprises obtaining a second liquid. Step 1018 comprises introducing the second liquid into at least one well comprising magnetic particles. Step 1020 comprises agitating the magnetic particles in at least one well to form a second suspension comprising the magnetic particles suspended in the second liquid. These steps may be performed in the order listed but need not be.

It should be understood that the present devices and methods are not intended to be limited to the particular forms disclosed. Rather, they are to cover all modifications, equivalents, and alternatives falling within the scope of the claims. For example, certain embodiments of the magnetic actuator 50 discussed above are shown configured for use with a well plate in an assay preparation module. However, magnetic actuator 50 is suitable for use in any small space where a controllable magnetic field may be required.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. For example, components may be combined as a unitary structure and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not to be interpreted as including means-plus- or step-plus-function limitations, unless such a limitation is explicitly recited in a given claim using the phrase(s) "means for" or "step for," respectively.

We claim:

1. A magnetic actuator configured to isolate particles in a fluid assay, the magnetic actuator comprising:

a first magnet magnetized in a first direction, a second magnet magnetized in a second direction, a third magnet magnetized in a third direction, and a fourth magnet magnetized in a fourth direction, wherein the directions are not identical and each direction is either parallel or orthogonal to the other directions such that a Halbach effect is induced on one side of the magnets;

a motor configured to rotate at least two of the first, second, third and fourth magnets;

a lateral support member configured to support the motor, the first magnet, the second magnet; the third magnet, and the fourth magnet; and a first linear magnet array comprising the first magnet, the second magnet, the third magnet, and the fourth magnet, where each of the first, second, third and fourth magnets is adjacent to at least one other of the first, second, third and fourth magnets;

wherein the motor is configured to rotate at least two of the first, second, third and fourth magnets in the linear magnet array approximately 180 degrees about an axis through the first magnet, the second magnet, the third magnet, and the fourth magnet.

2. The magnetic actuator of claim 1, wherein the motor is configured to rotate the first, second, third and fourth magnets in the first linear magnet array and wherein the first, second, third and fourth magnets in the first linear magnet array are configured to rotate together.

3. The magnetic actuator of claim 2, further comprising a second linear magnet array, a third linear magnet array, and a fourth linear magnet array.

4. The magnetic actuator of claim 1, wherein:

the first magnet further comprises a first axis of rotation;

the second magnet further comprises a second axis of rotation;

the third magnet further comprises a third axis of rotation;

the fourth magnet further comprises a fourth axis of rotation; and wherein each axis of rotation is substantially parallel to the other axes of rotation and the axes of rotation are not identical.

5. The magnetic actuator of claim 4, wherein each of the first, second, third and fourth magnets is configured to rotate approximately 90 degrees and adjacent magnets of the first, second, third and fourth magnets are configured to rotate in opposite directions.

6. The magnetic actuator of claim 4, wherein two magnets of the first, second, third and fourth magnets are configured to rotate about 180 degrees, two magnets of the first, second, third and fourth magnets are configured to remain stationary, the two magnets configured to rotate about 180 degrees are not adjacent to each other, and the two magnets configured to remain stationary are not adjacent to each other.

7. A system configured to isolate particles in a fluid assay comprising:

a chassis;

a magnetic actuator according to claim 1 coupled to the chassis;

a tub coupled to the chassis; and a well plate coupled to the tub and comprising a plurality of wells arranged in columns and rows; and where the tub is configured to support the well plate such that at least one of the first magnet, the second magnet, the third magnet or the fourth magnet is adjacent to at least one column of wells.

8. The system of claim 7; where the well plate further comprises eight columns and the first linear magnet array is adjacent to two columns of wells.

9. A method for collecting a sample of magnetic particles from a liquid, comprising:

obtaining a system comprising:

a chassis;

a magnetic actuator according to claim 1 coupled to the chassis;

a tub coupled to the chassis; and a well plate coupled to the tub and comprising a plurality of wells arranged in columns and rows; and where the tub is configured to support the well plate such that at least one of the first magnet, the second magnet, the third magnet or the fourth magnet is adjacent to at least one column of wells;

obtaining a first suspension comprising a plurality of magnetic particles suspended in a first liquid;

introducing a volume of the first suspension into at least one well of the plurality of wells;

adjusting the magnets to a first position such that a magnetic force is exerted on the at least one column of wells;

forming a pellet of magnetic particles in the at least one well of the plurality of wells; and aspirating a portion of the first liquid from the at least one well of the plurality of wells.

10. The method of claim 9, further comprising rotating the first linear magnet array to a second position such that substantially no magnetic force is exerted on any of the columns of the plurality of wells.

11. The method of claim 10, further comprising obtaining a second liquid and introducing the second liquid into the at least one well comprising magnetic particles.

12. The method of claim 11, further comprising agitating the magnetic particles in the at least one well to form a second suspension comprising the magnetic particles suspended in the second liquid.

13. A magnetic actuator configured to isolate particles in a fluid assay, the magnetic actuator comprising:

a first magnet array comprising:

an origin; and a linear subarray, the linear subarray comprising:

a first magnet element magnetized in a first direction relative to the origin;

a second magnet element magnetized in a second direction relative to the origin;

a third magnet element magnetized in a third direction relative to the origin; and a fourth magnet element magnetized in a fourth direction relative to the origin;

where the first direction, the second direction, the third direction, and the fourth direction are different from one another and either substantially parallel or substantially orthogonal to one another such that a Halbach effect is induced in the linear subarray;

where the first magnet array has a length, an axis of rotation along the length of the first magnet array, a max side, and a min side;

a motor coupled to the first magnet array and configured to rotate at least one magnet element of the first, second, third and fourth magnet elements about the axis of rotation along the length of the first magnet array; and a lateral support member configured to support the first magnet array and the motor.

14. The magnetic actuator of claim 13, further comprising a second magnet array comprising:

an origin; and a subarray, the linear subarray comprising:

a first magnet element magnetized in a first direction relative to the origin;

a second magnet element magnetized in a second direction relative to the origin;

a third magnet element magnetized in a third direction relative to the origin; and a fourth magnet element magnetized in a fourth direction relative to the origin;

where the first direction, the second direction, the third direction, and the fourth direction are different from one another and either substantially parallel or substantially orthogonal to one another such that a Halbach effect is induced in the linear subarray;

where the second magnet array has a length, an axis of rotation along the length of the second magnet array, a max side; and a min side; and where the lateral support member is further configured to support the second magnet array.

15. The magnetic actuator of claim 14, where each of the first, second, third, and fourth magnet elements in each of the first and second magnet arrays are configured to rotate together.

16. The magnetic actuator of claim 15, where the second magnet array is coupled to the first magnet array such that rotation of the first magnet array about the first axis of rotation rotates the second magnet about the second axis of rotation.

17. The magnetic actuator of claim 14, where at least some of the first, second, third, and fourth magnet elements in one of the first magnet array or the second magnet array are configured to rotate independently from others of the first; second, third, and fourth magnet elements in the one of the first ma the second magnet array.

18. A magnetic actuator configured to isolate particles in a fluid assay, the magnetic actuator comprising:

a first pair of magnet arrays rotatable together, each magnet array of the first pair of magnet arrays comprising a plurality of magnet elements arranged to induce a Halbach effect, where each magnet array of the first pair of magnet arrays has a length, an axis of rotation, a max side, and a min side;

a first motor coupled to the first pair of magnet arrays through a gearset and configured to rotate the first pair of magnet arrays about the axis of rotation of each magnet array of the first pair of magnet arrays;

a second pair of magnet arrays rotatable together, each magnet array of the second pair of magnet arrays comprising a plurality of magnet elements arranged to induce a Halbach effect, where each magnet array of the second pair of magnet arrays has a length, an axis of rotation along the length of each magnet array of the second pair of magnet arrays, a max side, and a min side;

a second motor coupled to the second pair of magnet arrays through a gearset and configured to rotate the second pair of magnet arrays about the axis of rotation along the length of each magnet array of the second pair of magnet arrays; and a lateral support member configured to support the magnet arrays and the motors;

where the magnetic actuator is configured to be coupled to an assay preparation module.

19. A magnetic actuator configured to isolate particles in a fluid assay, the magnetic actuator comprising:

a first uniform magnet having a length, a width, and a first axis of rotation substantially parallel to the length of the first uniform magnet, where the first uniform magnet is magnetized substantially uniformly through the width of the first uniform magnet in a first direction;

a second uniform magnet having a length, a width, and a second axis of rotation substantially parallel to the length of the second uniform magnet, where the second uniform magnet is magnetized substantially uniformly through the width of the second uniform magnet in a second direction;

a third uniform magnet having a length, a width, and a third first axis of rotation substantially parallel to the length of the third uniform magnet, where the first uniform magnet is magnetized substantially uniformly through the width of the third uniform magnet in a third direction; and a fourth uniform magnet having a length, a width, and a fourth axis of rotation substantially parallel to the length of the fourth uniform magnet, where the fourth uniform magnet is magnetized substantially uniformly through the width of the fourth uniform magnet in a fourth direction;

wherein the first axis of rotation, the second axis of rotation, the third axis of rotation, and the fourth axis of rotation are not identical to each other and are substantially parallel to each other;

wherein the first direction, second direction, third direction, and fourth direction are not identical to each other and each direction is parallel or orthogonal to each other direction; and wherein the uniform magnets are configured to induce a Halbach effect on the same side of all the uniform magnets;

a motor configured to rotate at least two of the uniform magnets; and a lateral support member configured to support the uniform magnets, wherein each magnet is configured to rotate 90 degrees and adjacent magnets are configured to rotate in opposite directions.

20. The magnetic actuator of claim 19, wherein two magnets are configured to rotate about 180 degrees, two magnets are configured to remain stationary; rotating magnets are not adjacent to each other, and stationary magnets are not adjacent to each other.

* * * * *